US009458698B2

(12) United States Patent
Harris et al.

(10) Patent No.: US 9,458,698 B2
(45) **Date of Patent: *Oct. 4, 2016**

(54) LINEARLY INDEXING WELL BORE SIMULATION VALVE

(71) Applicant: TEAM OIL TOOLS LP, The Woodlands, TX (US)

(72) Inventors: Michael J. Harris, Houston, TX (US); Kenneth J. Anton, Houston, TX (US)

( * ) Notice: Subject to any disclaimer, the term of this patent is extended or adjusted under 35 U.S.C. 154(b) by 353 days.

This patent is subject to a terminal disclaimer.

(21) Appl. No.: 13/987,053

(22) Filed: Jun. 28, 2013

(65) Prior Publication Data

US 2015/0000920 A1 Jan. 1, 2015

(51) Int. Cl.
*E21B 34/14* (2006.01)
*E21B 23/00* (2006.01)

(52) U.S. Cl.
CPC ..... *E21B 34/14* (2013.01); *E21B 23/004* (2013.01)

(58) Field of Classification Search
CPC .... E21B 34/102; E21B 34/108; E21B 34/14; E21B 43/26; E21B 43/162
See application file for complete search history.

(56) References Cited

U.S. PATENT DOCUMENTS

| | | | |
|---|---|---|---|
| 3,011,548 | A | 7/1958 | Holt |
| 4,893,678 | A | 1/1990 | Stokely et al. |
| 5,375,662 | A | 12/1994 | Echols, III et al. |
| 5,806,596 | A | 9/1998 | Hardy et al. |
| 6,059,032 | A | 5/2000 | Jones |
| 6,634,428 | B2 | 10/2003 | Krauss et al. |
| 6,907,936 | B2 | 6/2005 | Fehr et al. |
| 7,108,067 | B2 | 9/2006 | Themig et al. |
| 7,322,417 | B2 | 1/2008 | Rytlewski et al. |
| 7,325,616 | B2 | 2/2008 | Lopez de Cardenas et al. |
| 7,377,321 | B2 | 5/2008 | Rytlewski |
| 7,387,165 | B2 | 6/2008 | Lopez de Cardenas et al. |
| 7,416,029 | B2 | 8/2008 | Telfer et al. |

(Continued)

FOREIGN PATENT DOCUMENTS

| | | |
|---|---|---|
| EP | 0198406 A1 | 10/1986 |
| GB | 1359961 | 7/1974 |

(Continued)

OTHER PUBLICATIONS

Advanced Frac Systems, *Sidewinder Multiple Zone Stimulation Sleeve* (© 2014 Advanced Frac Systems).

(Continued)

*Primary Examiner* — Cathleen Hutchins
(74) *Attorney, Agent, or Firm* — Keith B. Willhelm

(57) ABSTRACT

Stimulation valves are provided that have a valve housing, an indexed driver, a reciprocating shifter, an actuation seat, and an isolation seat. The indexed driver is linearly actuated from an initial position through intermediate positions to a terminal position. In the driver initial and intermediate positions, the valve body shuts off fluid communication through ports provided in the housing. In the driver terminal position the valve body allows fluid communication through the ports. The reciprocating shifter indexes the indexed driver from its initial position through its intermediate positions to its terminal position. The actuation seat receives a ball for actuation of the shifter and releases the ball after actuation of the shifter. The isolation seat allows passage of the ball when the indexed driver is in its initial and intermediate positions and receives the ball when the indexed driver is in its terminal position.

35 Claims, 11 Drawing Sheets

(56) References Cited

U.S. PATENT DOCUMENTS

| | | | |
|---|---|---|---|
| 7,661,478 | B2 | 2/2010 | Palmer et al. |
| 8,261,761 | B2 | 9/2012 | Gerrard et al. |
| 8,276,674 | B2 | 10/2012 | Lopez de Cardenas et al. |
| 8,505,632 | B2 | 8/2013 | Guerrero et al. |
| 8,668,006 | B2 | 3/2014 | Xu |
| 8,789,600 | B2 | 7/2014 | O'Connell et al. |
| 2001/0045288 | A1 | 11/2001 | Allamon et al. |
| 2003/0136563 | A1 | 7/2003 | Allamon et al. |
| 2004/0035586 | A1 | 2/2004 | Gudmestad et al. |
| 2004/0069496 | A1 | 4/2004 | Hosie et al. |
| 2004/0108109 | A1 | 6/2004 | Allamon et al. |
| 2004/0118564 | A1 | 6/2004 | Themig et al. |
| 2004/0154839 | A1 | 8/2004 | McGarian et al. |
| 2007/0272411 | A1 | 11/2007 | Lopez de Cardenas et al. |
| 2008/0093080 | A1 | 4/2008 | Palmer et al. |
| 2009/0084553 | A1 | 4/2009 | Rytlewski et al. |
| 2009/0308588 | A1 | 12/2009 | Howell et al. |
| 2010/0270030 | A1 | 10/2010 | Ashy et al. |
| 2011/0042068 | A1 | 2/2011 | Rogers et al. |
| 2011/0192607 | A1 | 8/2011 | Hofman et al. |
| 2011/0203800 | A1 | 8/2011 | Tinker et al. |
| 2011/0240301 | A1 | 10/2011 | Robison et al. |
| 2011/0278017 | A1 | 11/2011 | Themig et al. |
| 2012/0073828 | A1 | 3/2012 | Churchill |
| 2012/0199349 | A1 | 8/2012 | Themig et al. |
| 2013/0025868 | A1 | 1/2013 | Smith et al. |
| 2013/0025876 | A1 | 1/2013 | McCoy et al. |
| 2013/0068475 | A1 | 3/2013 | Hofman et al. |
| 2013/0118732 | A1 | 5/2013 | Chauffe et al. |
| 2013/0255963 | A1 | 10/2013 | Guerrero et al. |
| 2013/0299199 | A1 | 11/2013 | Naedler et al. |

FOREIGN PATENT DOCUMENTS

| | | | |
|---|---|---|---|
| GB | 2323871 | A | 10/1998 |
| GB | 2389608 | A | 12/2003 |
| WO | 96/34176 | A2 | 10/1996 |
| WO | 96/34176 | A3 | 10/1996 |
| WO | 01/04457 | A1 | 1/2001 |
| WO | 01/90529 | A1 | 11/2001 |
| WO | 02/14650 | A1 | 2/2002 |
| WO | 02/061236 | A1 | 8/2002 |
| WO | 2004/031533 | A2 | 4/2004 |
| WO | 2004/031533 | A3 | 4/2004 |
| WO | 2004/083590 | A2 | 9/2004 |
| WO | 2004/083590 | A3 | 9/2004 |
| WO | 2004/088091 | A1 | 10/2004 |
| WO | 2005/085584 | A1 | 9/2005 |
| WO | 2006/134446 | A2 | 12/2006 |
| WO | 2006/134446 | A3 | 12/2006 |
| WO | 2010/129678 | A2 | 11/2010 |
| WO | 2013/016822 | A1 | 2/2013 |
| WO | 2014/043806 | A1 | 3/2014 |

OTHER PUBLICATIONS

Halliburton, Horizontal Completion Systems.

Schlumberger, *Falcon Ball-Actuated Frac Valve* (© 2012 Schlumberger).

Schlumberger, *Falcon Hydraulic-Actuated Frac Valve* (© 2012 Schlumberger).

Weatherford, *Real Results —ZoneSelect i-ball Multi-zone Fracturing Sleeves Isolate, Fracture 6 Lower Horizontal Openhole Sections in Bakken Shale* (© 2012 Weatherford).

Weatherford, *ZoneSelect i-ball Stimulation Sleeve* (© 2013 Weatherford).

Baker Hughes, *FracPoint EX-C Frac Sleeve System* (© 2011 Baker Hughes Incorporated).

International Search Report, Serial No. PCT/US2014/044,446 (Jul. 20, 2015).

Written Opinion of the International Searching Authority, Serial No. PCT/US2014/044,446 (Jul. 20, 2015).

Examiner's Report, Canadian Ser. No. 2,855,083, dated Nov. 6, 2015.

*Annex to Form PCT/ISA/206 Communication Relating to the Results of the Partial Int'l Search,* PCT Ser. No. PCT/US2015/056342, dated Jan. 27, 2016.

LINEARLY INDEXING WELL BORE SIMULATION VALVE

FIELD OF THE INVENTION

The present invention relates to valves used in oil and gas wells and, more particularly to improved sliding sleeve valves and methods of using sliding sleeve valves. The novel valves and methods are particularly suited for use as stimulation valves in completing oil and gas wells and in methods of fracturing hydrocarbon bearing formations and in other methods for stimulating production of hydrocarbons.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the well bore. This fluid serves to lubricate the bit and carry cuttings from the drilling process back to the surface. As the drilling progresses downward, the drill string is extended by adding more pipe sections.

When the drill bit has reached the desired depth, larger diameter pipes, or casings, are placed in the well and cemented in place to prevent the sides of the borehole from caving in. Cement is introduced through a work string. As it flows out the bottom of the work string, fluids already in the well, so-called "returns," are displaced up the annulus between the casing and the borehole and are collected at the surface.

Once the casing is cemented in place, it is perforated at the level of the oil bearing formation to create openings through which oil can enter the cased well. Production tubing, valves, and other equipment are installed in the well so that the hydrocarbons may flow in a controlled manner from the formation, into the cased well bore, and through the production tubing up to the surface for storage or transport.

This simplified drilling and completion process, however, is rarely possible in the real world. Hydrocarbon bearing formations may be quite deep or otherwise difficult to access. Thus, many wells today are drilled in stages. An initial section is drilled, cased, and cemented. Drilling then proceeds with a somewhat smaller well bore which is lined with somewhat smaller casings or "liners." The liner is suspended from the original or "host" casing by an anchor or "hanger." A seal also is typically established between the liner and the casing and, like the original casing, the liner is cemented in the well. That process then may be repeated to further extend the well and install additional liners. In essence, then, a modern oil well typically includes a number of tubes wholly or partially within other tubes.

Moreover, hydrocarbons are not always able to flow easily from a formation to a well. Some subsurface formations, such as sandstone, are very porous. Hydrocarbons are able to flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations. In particular, various techniques are available for increasing production from formations which are relatively nonporous.

One technique involves drilling a well in a more or less horizontal direction, so that the borehole extends along a formation instead of passing through it. More of the formation is exposed to the borehole, and the average distance hydrocarbons must flow to reach the well is decreased. Another technique involves creating fractures in a formation which will allow hydrocarbons to flow more easily. Indeed, the combination of horizontal drilling and fracturing, or "frac'ing" or "fracking" as it is known in the industry, is presently the only commercially viable way of producing natural gas from the vast majority of North American gas reserves.

Fracturing typically involves installing a production liner in the portion of the well bore which passes through the hydrocarbon bearing formation. In shallow wells, the production liner may actually be the casing suspended from the well surface. In either event, the production liner is provided, by various methods discussed below, with openings at predetermined locations along its length. Fluid, most commonly water, then is pumped into the well and forced into the formation at high pressure and flow rates, causing the formation to fracture and creating flow paths to the well. Proppants, such as grains of sand, ceramic or other particulates, usually are added to the frac fluid and are carried into the fractures. The proppant serves to prevent fractures from closing when pumping is stopped.

A formation usually is fractured at various locations, and rarely, if ever, is fractured all at once. Especially in a typical horizontal well, the formation usually is fractured at a number of different points along the bore in a series of operations or stages. For example, an initial stage may fracture the formation near the bottom of a well. The frac job then would be completed by conducting additional fracturing stages in succession up the well.

Some operators prefer to perform a frac job on an "open hole," that is without cementing the production liner in the well bore. The production liner is provided with a series of packers and is run into an open well bore. The packers then are installed to provide seals between the production liner and the sides of the well bore. The packers **2*i*** are spaced along the production liner at appropriate distances to isolate the various frac zones from each other. The zones then may be fractured in a predetermined sequence. The packers in theory prevent fluid introduced through the liner in a particular zone from flowing up or down the well bore to fracture the formation in areas outside the intended zone.

Certain problems arise, however, when an open hole is fractured. The distance between packers may be substantial, and the formation is exposed to fluid pressure along that entire distance. Thus, there is less control over the location at which fracturing of a formation will occur. It will occur at the weakest point in the frac zone, i.e., the portion of the well bore between adjacent packers. Greater control may be obtained by increasing the number of packers and diminishing their separation, but that increases the time required to complete the frac job. Moreover, even if packers are tightly spaced, given the extreme pressures required to fracture some formations and the rough and sometimes frangible surface of a well bore, it may be difficult to achieve an effective seal with a packer. Thus, fluid may flow across a packer and fracture a formation in areas outside the intended zone.

In part for such reasons, many operators prefer to cement the production liner in the well bore before the formation is fractured. Cement is circulated into the annulus between the production liner and well bore and is allowed to harden before the frac job is commenced. Thus, frac fluid first penetrates the cement in the immediate vicinity of the inner openings before entering and fracturing the formation. The cement above and below the liner openings serves to isolate other parts of the formation from fluid pressure and flow. Thus, it is possible to control more precisely the location at which a formation is fractured when the production liner is first cemented in the well bore. Cementing the production liner also tends to more reliably isolate a producing formation than does installing packers. Packers seat against a relatively small portion of the well bore, and even if an effective seal is established initially, packers may deteriorate as time passes.

There are various methods by which a production liner is provided with the openings through which frac fluids enter a formation. In a "plug and perf" frac job, the production liner is made up from standard lengths of casing. The liner does not have any openings through its sidewalls. It is installed in the well bore, either in an open bore using packers or by cementing the liner, and holes then are punched in the liner walls. The perforations typically are created by so-called perforation guns which discharge shaped charges through the liner and, if present, adjacent cement.

The production liner typically is perforated first in a zone near the bottom of the well. Fluids then are pumped into the well to frac the formation in the vicinity of the perforations. After the initial zone is fracked, a plug is installed in the liner at a point above the fractured zone to isolate the lower portion of the liner. The liner then is perforated above the plug in a second zone, and the second zone is fracked. That process is repeated until all zones in the well are fractured.

The plug and perf method is widely practiced, but it has a number of drawbacks. Chief among them is that it can be extremely time consuming. The perf guns and plugs must be run into the well and operated individually, often times at great distance and with some difficulty. After the frac job is complete, it also may be necessary to drill out or otherwise remove the plugs to allow production of hydrocarbons through the liner. Thus, many operators prefer to frac a formation using a series of frac valves.

Such frac valves typically include a cylindrical housing that may be threaded into and forms a part of a production liner. The housing defines a central conduit through which frac fluids and other well fluids may flow. Ports are provided in the housing that may be opened by actuating a sliding sleeve. Once opened, fluids are able to flow through the ports and fracture a formation in the vicinity of the valve.

The sliding sleeves in such valves traditionally have been actuated either by creating hydraulic pressure behind the sleeve or by dropping a ball on a ball seat which is connected to the sleeve. Typical multi-stage fracking systems will incorporate both types of valves. Halliburton's RapidSuite sleeve system and Schlumberger's Falcon series sleeves, for example, utilize a hydraulically actuated "initiator" valve and a series of ball-drop valves.

More particularly, the production liner in those systems is provided with a hydraulically actuated sliding sleeve valve which, when the liner is run into the well, will be located near the bottom of the well bore in the first fracture zone. The production liner also includes a series of ball-drop valves which will be positioned in the various other fracture zones extending uphole from the first zone.

A frac job will be initiated by increasing fluid pressure in the production liner. The increasing pressure will actuate the sleeve in the bottom, hydraulic valve, opening the ports and allowing fluid to flow into the first fracture zone. Once the first zone is fractured, a ball is dropped into the well and allowed to settle on the ball seat of the ball-drop valve immediately uphole of the first zone. The seated ball isolates the lower portion of the production liner and prevents the flow of additional frac fluid into the first zone. Continued pumping will shift the seat downward, along with the sliding sleeve, opening the ports and allowing fluid to flow into the second fracture zone. The process then is repeated with each ball-drop valve uphole from the second zone until all zones in the formation are fractured.

Such systems have been used successfully in any number of well completions. The series of valves avoids the time consuming process of running and setting perf guns and plugs. Instead, a series of balls are dropped into the well to successively open the valves and isolate downhole zones. It may still be necessary, however, to drill out the liner to remove the balls and seats prior to production. Unlike plug and perf jobs, there also is a practical limit to the number of stages or zones that can be fractured.

That is, the seat on each valve must be big enough to allow passage of the balls required to actuate every valve below it. Conversely, the ball used to actuate a particular valve must be smaller than the balls used to actuate every valve above it. Given the size constraints of even the largest diameter production liners, only so many different ball and seat sizes may be accommodated. Halliburton's RapidStage ball-drop valves, for example, only allow for fracking of up to twenty zones. While that capability is not insignificant, operators may prefer to perform an even greater number of stages using a single liner installation.

Thus, various designs have been proposed for "indexing" ball-drop frac valves. That is, ball-drop valves have been designed to allow an initial ball of a given size to pass through a particular valve in a production liner without actuating the sliding sleeve to open the valve ports. It will pass through the valve typically to actuate the sleeve and open the ports in another valve located downhole from the first valve. After one or more balls are allowed to pass, depending on the design, the uphole valve may be actuated by pumping another ball of the same size into the valve. Balls of the same size, therefore, may be used to actuate two or more valves in the production liner.

Examples of such indexing ball-drop frac valves are disclosed in U.S. Pat. App. Publ. 2013/0,025,868 of C. Smith et al. ("Smith '868"), U.S. Pat. App. Publ. 2011/0,278,017 of D. Themig et al. ("Themig '017"), U.S. Pat. App. Publ. 2009/0,308,588 of M. Howell et al. ("Howell '588"), and U.S. Pat. App. Publ. 2011/0,203,800 of D. Tinker et al. ("Tinker '800"). Smith '868, for example, discloses a traveling collet that indexes linearly, that is, that indexes along the main axis running lengthwise through the tool. More specifically, the traveling collet indexes linearly down through the central conduit of the valve as successive balls—all of the same size—are passed through the valve. The collet catches and then releases each of the initial balls, indexing down one unit as each ball passes. When it is fully indexed, the travelling collet engages a sliding sleeve, driving it downward to open the ports.

More specifically, the traveling collet has an upper and a lower set of fingers. Each set of fingers undergo relative expansion and compression as protrusions on the fingers ride in and out of a series of annular recesses spaced out along the central conduit. When the fingers are riding out of a recess, they are compressed and will form a seat that can capture a ball. When they ride into a recess, the fingers relax, and the ball is able to pass through the fingers.

In the run-in position, the upper fingers on the travelling collet are riding out of a recess and are in their compressed state and form a ball seat. The lower fingers are resting in a recess. When a ball is dropped, therefore, it will land on the seat formed by the upper fingers and hydraulic pressure behind the ball will drive the collet downward. As the collet travels downward, the upper fingers will move into a recess, allowing the upper fingers to expand and release the ball. By this time, however, the lower fingers have been driven out of their recess, and now are compressed and form a ball seat. The ball which has just been released by the upper fingers, therefore, will land on the seat formed by the lower fingers and drive the travelling collet further down the main bore. That movement causes the upper fingers to ride out of their recesses—to reform a ball seat—and causes the lower fingers to ride into another, lower recess and release the ball.

The net effect of that catch-release-catch-release is that the first ball will pass through the valve without opening the ports, but will caused the travelling collet to index downward one unit. Successive balls of the same size then may be dropped through the valve until the travelling collet is fully indexed. The next ball that is dropped then will actuate the sleeve and open the ports.

Themig '017 discloses a similar travelling collet with a lower set of fingers (a "catcher") and an upper set of fingers (a "ball stop"). The travelling collet, however, is not configured to index down multiple units. A first ball will pass through the ball stop and land on the catcher, shifting the collet down. As the collet moves down, the catcher ramps open and releases the ball while the ball stop is compressed. The next ball, therefore, passes through the catcher, lands on the ball stop, and actuates the sleeve to open the ports. Other types of catchers and ball stops are disclosed, such as a shear out actuation ring, radially compressible, resilient C-rings, and elastically deformable seats.

Themig '017 also discloses valves that may be indexed several times. Those valves have a reciprocating driver that rotates within the central conduit and indexes angularly about the tool's main axis as successive balls are passed through the valve. The driver catches and then releases each ball, reciprocating linearly and indexing angularly one unit. When it is fully indexed, the driver catches, but does not release the next ball pumped into the valve, and drives the sleeve to open the ports.

More particularly, the driver in the Themig '017 valve is spring-loaded and is mounted in the central conduit by cooperating pins and a walking-J keyway. The driver has a radially compressible and resilient C-ring that may be compressed to form a ball seat and allowed to expand so as to release a ball. The first ball will land on the compressed C-ring and urge the driver downward until the C-ring expands and releases the ball. After the ball is released, the spring will urge the driver back upward so as to compress the C-ring into a ball seat again. That reciprocating movement will cause the driver to rotate along the keyway and index angularly one unit. Successive balls will cause the driver to reciprocate and rotate angularly additional units until the driver has been fully indexed. At that point, the C-ring will capture, but not release the next ball pumped into the valve, and the keyway allows the driver to move downward into engagement with the sleeve to open the ports.

Howell '588 discloses a reciprocating driver which indexes angularly in a similar fashion. Instead of a compressible C-ring, however, the driver has a set of collet fingers that may be compressed to form a ball seat. The collet fingers first engage and then release successive balls until the driver has been fully indexed. Once the driver has been fully indexed, the next ball will land on the collet fingers, which are now prevented from expanding, and move the driver into engagement with the sleeve to open the ports.

Tinker '800 discloses indexing ball-drop valves, but unlike the valves disclosed in Smith '868, Themig '017, and Howell '588 as discussed above, the valves do not utilize a collet or other type of driver that indexes—either linearly or angularly—and then engages and drives a valve sleeve. Instead of ultimately being actuated by an indexing driver, the sliding sleeve in the Tinker '800 valves indexes down the valve. That is, the valve sleeve is spring loaded. A ball passing through the valve will land on a load pawl and ratchet pawl. As the ball is blown through the pawls, they are deflected and allow the spring to index the sleeve downward one unit. Successive balls will index the sleeve additional units, until the sleeve uncovers the port.

Such designs, at least in theory, offer the promise of being able to selectively actuate a particular valve, and to actuate a series of valves in succession using a single-sized ball. At the same time, however, they suffer various shortcomings. For example, when a ball is pumped down a production liner, especially if the ball is relatively large, it will impact a ball seat with considerable force. Such force may be sufficient to cause a traveling, linearly indexing driver, such as the collets used in the Smith '868 valves, to index more than one unit. If that happens, the valve may be opened too soon and a downstream valve may never be opened. It may be opened with the initial ball, in which case none of the downstream valves will be opened. Alternately, if the valve was not supposed to open until the fourth ball was dropped, for example, it may instead open on the third or second ball pumped through the liner, again leaving one or more downstream valves unopened.

Valves that utilize a rotating, angularly indexing driver, such as the valves disclosed in Themig '017 and Howell '588, are not so susceptible to such problems. The driver must travel back upwards before it can index another unit. Rotating, angularly indexing drivers utilizing pins and keyways, however, are susceptible to jamming, especially when a valve is run into a horizontal well bore. Torque and friction can be created around the driver that may interfere with its operation.

Conventional valves, of both the linearly indexing and angularly indexing designs, also often are poorly suited for incorporation into a liner that will be cemented in place prior to fracturing the formation. Cement passing through the valve conduit when the casing is cemented may hang up in the valve and interfere with subsequent operation of the sleeve or travel of the driver. In addition, many such designs create restrictions through the bore that may undesirably limit the flow of production fluids from the formation to the surface.

It also will be appreciated that indexing valves, like basic ball drop valves, incorporate a seat upon which a ball may land so as to restrict flow of fluids through the valve, thereby allowing fluid flow to be directed out the housing ports once they have been opened. While such isolation seats necessarily must capture a ball after the ports have been opened, they must allow the balls that are used to index the valve before the ports are opened to pass through the valve. In addition, once a ball has landed on the isolation seat and fracturing has been completed, the ball must be released or otherwise removed from the seat so that production is allowed to flow upwards through the valve. The isolation seats also must allow balls to pass back through the valve. Indexing valves, therefore, have incorporated isolation seats that are designed to selectively capture and release a ball.

For example, Weatherford's ZoneSelect i-ball valve, which appears to correspond generally to the valves disclosed in Smith '868, incorporates a spring-loaded collet with fingers that may be compressed to form an isolation ball seat. The fingers on the spring-loaded collet remain in an expanded state as the traveling collet indexes down the tool. The balls used to index the travelling collet, therefore, are allowed to pass through the valve.

When the travelling collet is fully indexed it will drive the sliding sleeve downward to open the ports, which in turn drives the spring-loaded collet downward against resistance from the spring. As it travels downward, the fingers on the spring-loaded collet are compressed into a seat which captures the ball and restricts flow of fluid through the valve. Fluid pumped into the liner, therefore, is forced out the ports to fracture the formation.

Once pumping is stopped, the spring urges the collet upwards toward its original position, allowing the fingers to once again expand. The ball captured by the spring-loaded collet is thereby released. Balls which had passed through the valve to index or isolate downhole valves also are able to flow back up the liner through the valve and, specifically, through the spring-loaded collet.

A problem can arise, however, if pumping is interrupted for any reason after the ports have been opened, but before fracturing of the formation is completed. Any reduction in hydraulic pressure above the valve during such interruptions may allow the spring-loaded collet to travel upward toward its original position and release the ball. Once that happens, the collet is incapable of recapturing the ball so that flow through the valve is shut off. An operator, therefore, will no longer have the ability to selectively fracture the formation adjacent the valve. Any continued pumping will force fluids not only through the ports in the valve, but also through ports in opened valves downhole of the valve.

The ability to selectively inject fluid into various zones in a well bore is important not only in fracturing, but in other processes for stimulating hydrocarbon production. Aqueous acids such as hydrochloric acid may be injected into a formation to clean up the formation. Water or other fluids may be injected into a formation from a "stimulation" well to drive hydrocarbons toward a production well. In many such stimulation processes, as in fracturing a well, the ability to selectively flow fluids out a series of valves may improve the efficacy and efficiency of the process.

Accordingly, there remains a need for new and improved sliding sleeve stimulation valves and for new and improved methods for fracking or otherwise stimulating formations using sliding sleeve valves. Such disadvantages and others inherent in the prior art are addressed by various aspects and embodiments of the subject invention.

SUMMARY OF THE INVENTION

The subject invention, in its various aspects and embodiments, is directed generally to valves used in stimulating production in oil and gas wells and, more particularly to improved sliding sleeve valves and methods of using sliding sleeve valves. The novel valves and methods are particularly suited for use as frac valves in completing oil and gas wells and in methods of fracturing hydrocarbon bearing formations.

One aspect of the invention provides for a stimulation valve for a well liner or other well tubular. The stimulation valve comprises a cylindrical housing, a valve body, an indexed driver, a reciprocating shifter, an actuation seat, and an isolation seat. The housing is adapted for assembly into a tubular for a well. The housing defines a conduit for passage of fluids through the housing and a port allowing fluid communication between the conduit and the exterior of the housing. The valve body is adapted for movement from a closed position restricting fluid communication through the port to an open position allowing fluid communication through the port. The driver is adapted for linear indexing from an initial position through one or more intermediate positions to a terminal position. The indexed driver is operatively connected to the valve body such that the valve body moves from its closed position to its open position as the indexed driver moves to its terminal position. The reciprocating shifter is adapted to index the indexed driver from its initial position through its intermediate positions to its terminal position. The shifter comprises an actuation seat adapted to receive a ball for actuation of the shifter and to release the ball after actuation of the shifter. The isolation seat is adapted to allow passage of the ball when the indexed driver is in its initial and intermediate positions and to receive the ball when the indexed driver is in its terminal position. The ball will block fluid flow through the conduit when received by the isolation seat.

Other aspects provide a stimulation valve wherein the valve body is part of or otherwise is joined to the indexed driver such that the valve body is indexed from an initial position through intermediate positions to a terminal position, the valve body moving to its open position as it is indexed to its terminal position.

Yet other aspects and embodiments provide a stimulation valve where the actuation seat is a split ring and where the split ring is carried on the shifter under compression and sized to receive the ball and is adapted to expand and release the ball after the shifter has indexed the indexed driver.

Still other aspects provide for a stimulation valve where the shifter is a spring-loaded sleeve and a stimulation valve where the valve body is a sleeve.

The subject invention in other aspects and embodiments also provides for a stimulation valve where the indexed mechanism comprises first and second ratchet mechanisms. The first ratchet mechanism allows the indexed mechanism to index relative to the housing and the second ratchet mechanism allows the indexed mechanism to index relative to the shifter. The first ratchet mechanism may comprise a pawl adapted to engage detents provided in the housing or the indexed driver. The second ratchet mechanism may comprise a pawl adapted to engage detents provided in the indexed driver or the shifter.

Further embodiments provide a stimulation valve where the indexed driver is a drive sleeve having a first split ring and a second split ring mounted therein. The first split ring is adapted to selectively engage a first set of annular detents in the housing so as to allow the drive sleeve to index relative to the housing. The second split ring is adapted to selectively engage a second set of annular detents in the shifter so as to allow the drive sleeve to index relative to the shifter.

Another aspect of the invention provides a stimulation valve where the housing has a first split ring mounted therein and the indexed driver is a drive sleeve having a second split ring mounted therein. The first split ring is adapted to selectively engage a first set of annular detents in the drive sleeve so as to allow the drive sleeve to index relative to the housing. The second split ring is adapted to selectively engage a second set of annular detents in the shifter so as to allow the drive sleeve to index relative to the shifter.

Yet other aspects provide a stimulation valve where the isolation seat is a split ring sized to allow passage of the ball when the valve body is in the closed position. The split ring is mounted for compression when the valve body is in the open position and is adapted to receive the ball when the split ring is compressed.

Other aspects of the subject invention provide a stimulation valve where the split ring is mounted for compression in the valve body. The valve body has an area of reduced diameter adapted to compress the split ring as the valve body moves from the closed position to the open position and preferably also has an area of enlarged diameter above the reduced diameter area where the split ring is adapted for displacement into the enlarged diameter area by a ball passing upwards through the valve. Displacement of the split ring will allow the split ring to expand and allow passage of the ball.

Further embodiments provide a stimulation valve where the valve body engages a compression sleeve as the valve body moves from the closed position to the open position and the split ring is mounted for compression in the compression sleeve. The compression sleeve has an area of reduced diameter adapted to compress the split ring as the compression sleeve seat is engaged by the valve body. Preferably, the compression sleeve also has an area of enlarged diameter above the reduced diameter area and the split ring is adapted for displacement into the enlarged diameter area by a ball passing upwards through the valve. Displacement of the split ring will allow the split ring to expand and allow passage of the ball.

Yet other aspects and embodiments provide a stimulation valve where the split ring is releasably mounted at the lower end of the valve body. The valve body is adapted to transfer the split ring to a compression sleeve as the valve body moves from the closed position to the open position. The compression sleeve is adapted to receive and compress the split ring. Preferably, the split ring is adapted for displacement from the compression sleeve by a ball passing upwards through the valve. Displacement of the split ring will allow the split ring to expand and allow passage of the ball.

Various other aspects and embodiments provide a stimulation valve where the housing defines an intermediate portion having an enlarged diameter and the reciprocating shifter is a sleeve mounted within the intermediate, enlarged diameter portion of the housing. The shifter sleeve has an inner diameter substantially equal to the inner diameter of the housing above and below the intermediate enlarged diameter portion. Preferably, the shifter sleeve extends the substantial distance through the enlarged portion of the housing.

Other embodiments and aspects provide a stimulation valve for a well tubular. The stimulation valve comprises a cylindrical housing adapted for assembly into a tubular for a well and defining a conduit for passage of fluids through the housing and a port allowing fluid communication between the conduit and the exterior of the housing. It also comprises a valve body and an indexing mechanism. The valve body is adapted for movement from a closed position restricting fluid communication through the port to an open position allowing fluid communication through the port. The indexing mechanism is adapted for indexing from an initial position through one or more intermediate positions to a terminal position. The indexing mechanism is operatively connected to the valve body such that the valve body moves from its closed position to its open position as the indexing mechanism moves to its terminal position. The valve also comprises an isolation seat adapted to allow passage of a ball of a defined size when the indexed driver is in its initial and intermediate positions and to receive a ball of the defined size when the indexed driver is in its terminal position. The isolation seat is further adapted for displacement by upward flow of a ball of the defined size, the displacement of the isolation seat allowing passage of the displacing ball through the isolation seat.

The subject invention in other aspects and embodiments is directed to production liners and other tubulars for oil and gas wells and, especially, tubulars that allow fracturing or other stimulation of a formation after the tubular has been installed. Thus, other aspects provide for a liner or other tubular that is adapted for installation in a well and which comprises one or more of the novel stimulation valves in any of their various embodiments and methods of using the tubulars.

Similarly, further aspects and embodiments are directed to methods of stimulating, and especially fracturing a formation in a well. Such embodiments comprise installing a liner or other tubular in the well. The tubular comprises an uphole stimulation valve and a downhole stimulation valve. The stimulation valves may be any of the various embodiments of the novel stimulation valves. A first ball then is pumped through the liner to index the uphole stimulation valve and to open the downhole stimulation valve. Fluid is pumped through the liner and out the opened downhole stimulation valve to fracture or otherwise stimulate the formation adjacent the downhole stimulation valve. A second ball then is pumped through the liner to open the uphole stimulation valve. The first and second balls are substantially identical. Fluid is pumped through the liner and out the opened uphole stimulation valve to fracture or otherwise stimulate the formation adjacent the uphole stimulation valve. Such methods preferably comprise cementing the liner is the well.

Other embodiments of the novel methods comprise installing a tubular in the well where the tubular comprises an indexing stimulation valve having an isolation seat which is displaceable from a closed position to an open position. A first ball is pumped through the tubular. The first ball indexes the valve and passes through the valve and the isolation seat. A second ball then is pumped through the tubular. The second ball is substantially identical to the first ball. The second ball actuates the valve to open ports therein and to close the isolation seat such that the second ball is received on the isolation seat to restrict flow through the valve. Fluid then is pumped out the ports to stimulate the formation adjacent the valve. The first ball then is flowed upward through the valve. The upward flow of the first ball displaces the isolation seat, allowing it to move from its closed position to its open position. The first ball, therefore, is able to pass back through the valve.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide, a better understanding of the invention and the manner in which it may be practiced. The subject invention encompasses other embodiments consistent with the claims set forth herein.

Figure 1A:
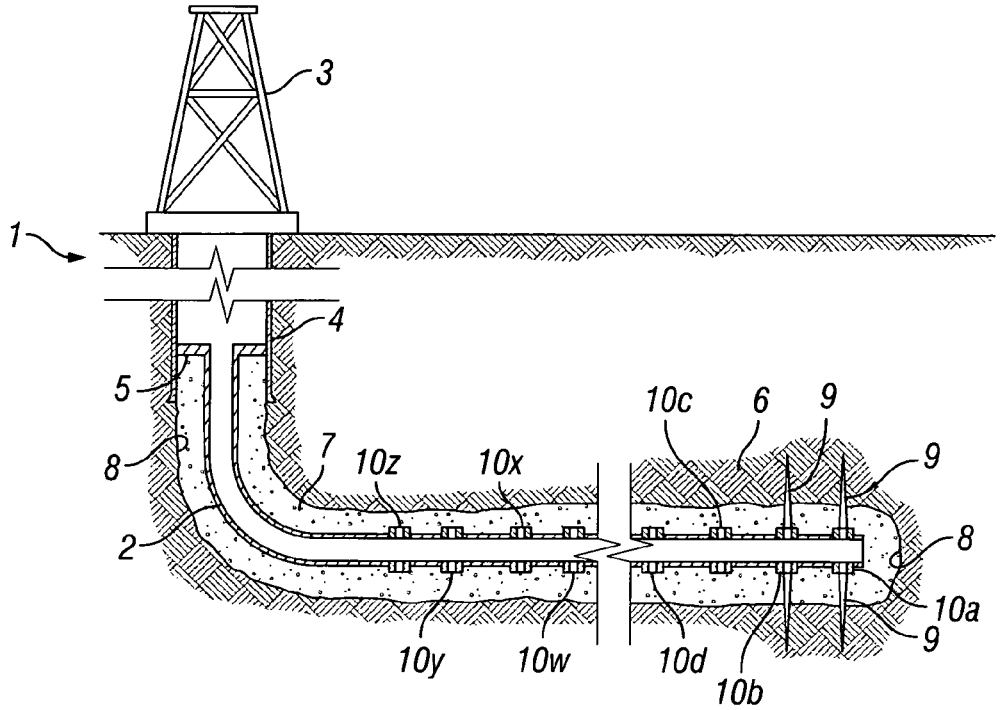
FIG. 1A is a schematic illustration of a preferred embodiment 2 of the tubular assemblies of the subject invention showing the initial stages of a frac job.

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to valves used in oil and gas well operations and especially to stimulation valves used in completing oil and gas wells. Broader embodiments of the novel valves comprise a cylindrical housing, a valve body, a driver, a reciprocating shifter, an actuation seat, and an isolation seat. The housing is adapted for assembly into a tubular string such as a liner for a well. The valve housing defines a conduit for the passage of fluids through the housing. Preferably the conduit has a substantially uniform diameter. The housing has a port which can allow fluids to pass from the conduit to the exterior of the valve. The port may be shut off or left open by a valve body mounted on the housing.

The valve body is adapted for movement from a closed position restricting fluid communication through the port to an open position allowing fluid communication through the port. The driver is adapted for linear indexing from an initial position through one or more intermediate positions to a terminal position. The valve body and indexed driver may be a single component or separate components. In either event, the indexed driver is operatively connected to the valve body such that the valve body moves from its closed position to its open position as the indexed driver moves to its terminal position.

The reciprocating shifter is adapted to engage and index the indexed driver from the initial position, through the intermediate positions to the terminal position. The actuation seat is mounted on the reciprocating shifter and is adapted to receive a ball for actuation of the shifter and to release the ball after actuation of the shifter. The isolation seat is adapted to allow passage of the ball when the indexed driver is in the initial and intermediate positions and to receive the ball when the indexed driver is in the terminal position. A ball seated on the isolation seat will block fluid from flowing through the central conduit.

For example, a first preferred frac valve 10 is illustrated in FIGS. 1-9. As may be seen in the schematic representations of FIG. 1, a number of frac valves 10 may be incorporated into production liner 2 which forms part of a typical oil and gas well 1. Well 1 is serviced by a derrick 3 and various other surface equipment (not shown). The upper portion of well 1 is provided with a casing 4. Production liner 2 has been installed in the lower portion of casing 4 via a liner hanger 5. It will be noted that the lower part of well 1 extends generally horizontally through a hydrocarbon bearing formation 6 and that liner 2 has been cemented in place. That is, cement 7 has been introduced into the annular space between liner 2 and the well bore 8.

Figure 1B:
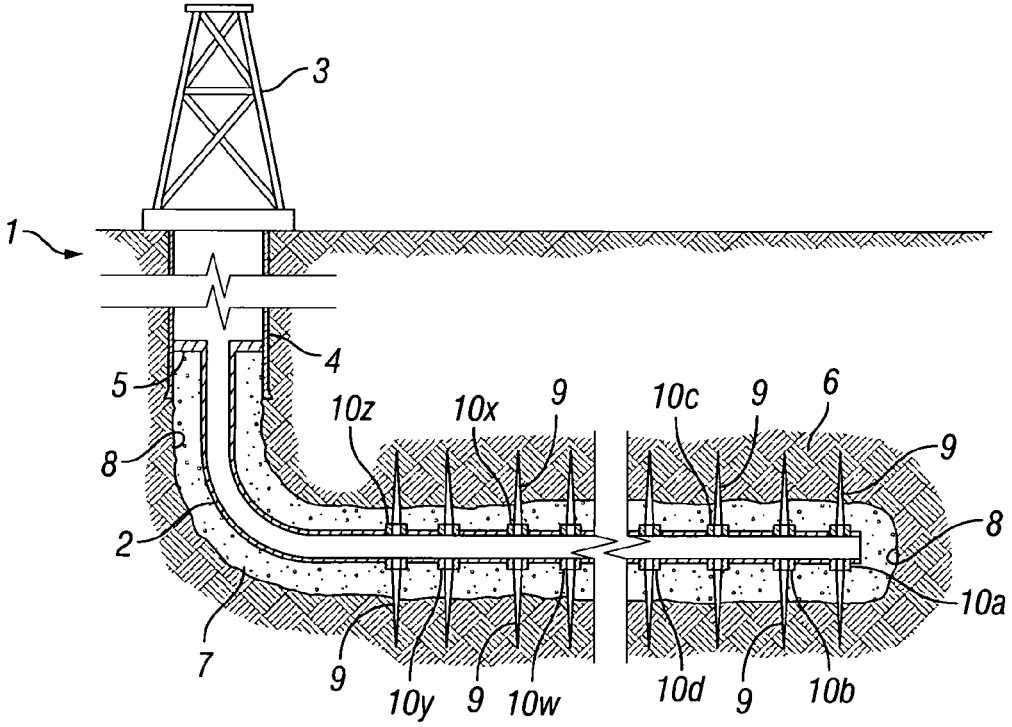
FIG. 1B is a schematic illustration of novel liner assembly 2 shown in FIG. 1A showing completion of the frac job.

FIG. 1A shows well 1 after the initial stages of a frac job have been completed. As discussed in greater detail below, a typical frac job will generally proceed from the lowermost zone in a well to the uppermost zone. FIG. 1A, therefore, shows that fractures 9 have been established adjacent to valves 10*a* and 10*b* in the first two zones near the bottom of well 1. Zones further uphole in well 1 will be fracked in succession until, as shown in FIG. 1B, all stages of the frac job have been completed and fractures 9 have been established in all zones. It also will be noted that production liner 2 is shown only in part as such liners may extend for a substantial distance. The portion of liner 2 not shown also will incorporate a number of valves 10, and well 1 will be provided with additional fractures 9 in the areas not shown in FIG. 1.

Preferred novel frac valve 10 is shown in greater detail in FIGS. 2-9. As shown in overview in FIGS. 2-3, frac valve 10 generally comprises a housing 20, an actuation ball seat 31, a reciprocating shifter sleeve 30, an indexed drive sleeve 40, a valve sleeve 50, and an isolation ball seat 51. Housing 20, as is typical of many downhole tools, is generally cylindrical and serves as the frame to which the other valve components are mounted, directly or indirectly. Housing 20 and other components collectively define an axial, central conduit 21 through which well fluids may pass. Housing 20 also has ports 22 which, when valve sleeve 50 is in an open position, allow fluid to pass from conduit 21 to the exterior of housing 20, as may be seen in greater detail in FIGS. 4C to 9C.

Figure 2:
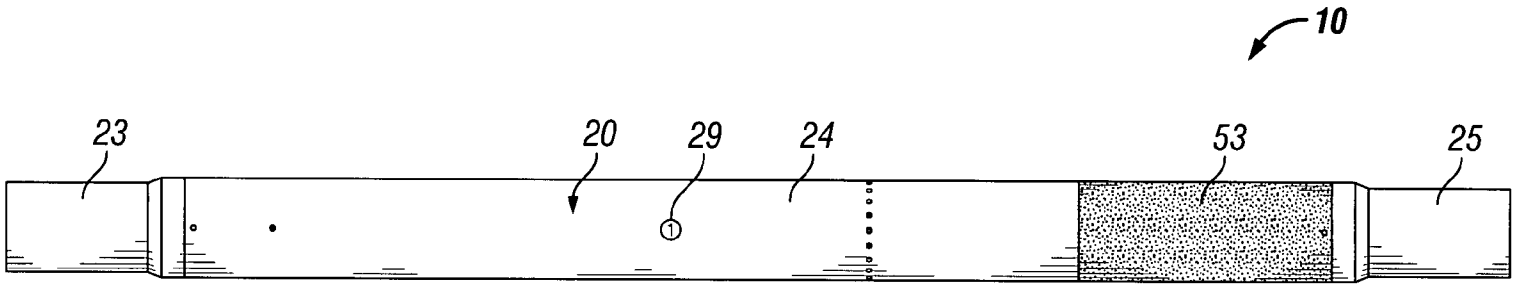
FIG. 2 is a perspective view of a preferred embodiment 10 of the stimulation valves of the subject invention showing frac valve 10 in its closed or run-in position.
Figure 3:
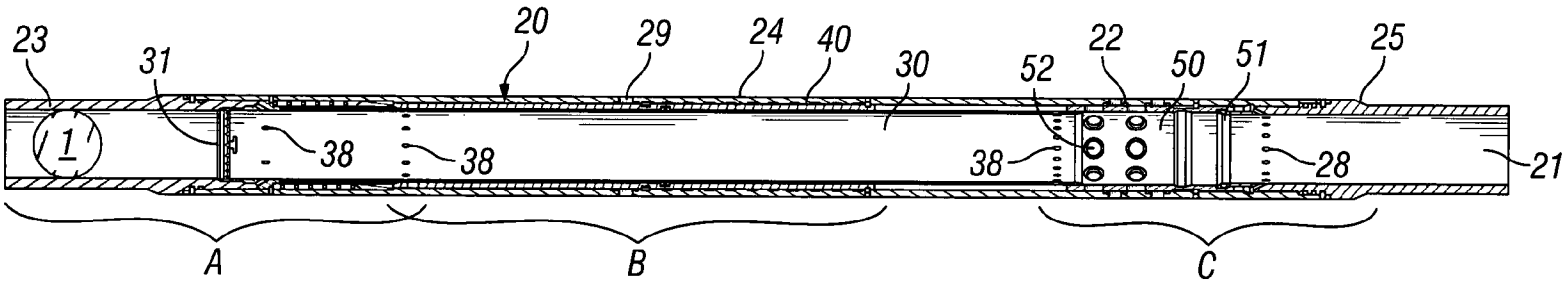
FIG. 3 is an axial cross-sectional view of novel frac valve 10 showing frac valve 10 in its closed or run-in position.
Figure 4A:
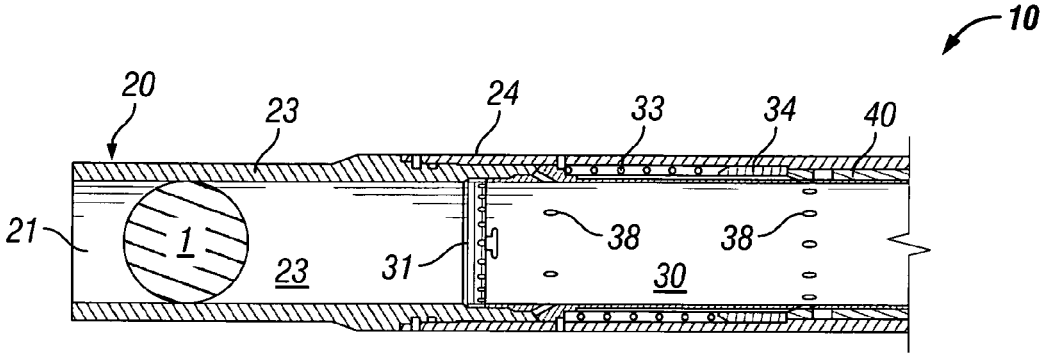
FIGS. 4A to 4C are enlarged axial cross-sectional views generally corresponding, respectively, to sections A to C of novel frac valve 10 shown in FIG. 3 showing novel frac valve 10 in its closed or run-in position, FIG. 4A showing a first drop ball 1 approaching an actuation ball seat 31 on a reciprocating shifter sleeve 30.
Figure 5A:
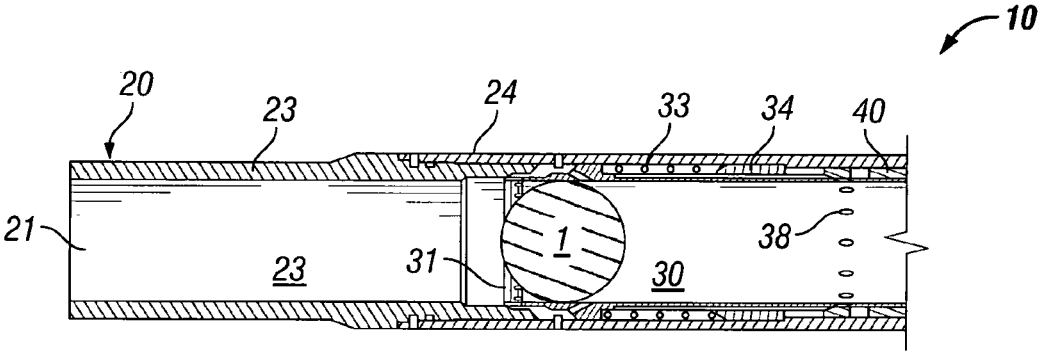
FIGS. 5A to 5C are enlarged axial cross-sectional views similar, respectively, to the views of FIGS. 4A to 4C showing novel frac valve 10 after shifter sleeve 30 has completed its down stroke and actuation ball seat 31 has released drop ball 1.

More particularly, as may be seen generally in FIGS. 2-3 and in greater detail in FIGS. 4-9, housing 20 generally comprises an upper housing sub 23, an intermediate housing sub 24, and a lower housing sub 25, each of which are generally cylindrically shaped, tubular components. Subs 23, 24, and 25 are threaded together or otherwise assembled by means common in the art, such as threaded connections. Upper housing sub 23 and lower housing sub 25 also are adapted for assembly into liner joints and other tubulars. Thus, for example, the upper end of upper housing sub 23 and the lower end of lower housing sub 25 are provided with threads so that valve 10 may be threaded into production liner 2.

The inner diameter of intermediate housing sub 24 is generally enlarged somewhat relative to the inner diameter of upper housing sub 23 and lower housing sub 25 since it primarily accommodates the other valve components, such as shifter sleeve 30, drive sleeve 40, and valve sleeve 50. Thus, for reasons discussed below, housing 20 may be provided with a central conduit 21 that has a substantially uniform internal diameter relatively free of profiles.

The housing of the novel valves has a port therein that allows passage of well fluids. Preferably, as in preferred valve 10 and seen best in FIGS. 4C to 9C, they are provided with a plurality of ports, such as flow ports 22. Flow ports 22 may be arranged radially around a portion of intermediate housing sub 24. It will be noted that intermediate housing sub 24 includes two longitudinally spaced sets of radially arranged ports 22. The precise number and arrangement of flow ports 22, however, and their cross section, in general are not critical to practicing the invention. They may be varied as desired to provide whatever flow capacity as may be desired for the novel valves.

Actuation ball seat 31, as may be seen generally in FIG. 3 and in greater detail in FIGS. 4A to 9A, is mounted on the upper end of reciprocating shifter sleeve 30 near the upper portion of valve 10. Shifter sleeve 30 is a generally cylindrical sleeve extending though a substantial portion of the interior of housing 20. More particularly, it will be noted that shifter sleeve 30 is mounted generally within the enlarged diameter, intermediate housing sub 24 and, preferably, extends the substantial distance of intermediate housing sub 24. Preferably, as in valve 10, the inner diameter of shifter sleeve 30 is the same as or closely approximates the inner diameter of upper housing sub 23 and lower housing sub 25. Central conduit 21 of valve 10, therefore, is provided with a substantially uniform diameter which is substantially free of profiles along the substantial majority of its length.

Shifter sleeve 30 is mounted for reciprocating linear movement within housing 20 and is biased upwards by a resilient member, such as compression spring 33. Spring 33 is disposed between shifter sleeve 30 and intermediate housing sub 24 and is mounted under compression between an outwardly projecting shoulder provided on shifter sleeve 30 and a support ring 34 mounted within intermediate housing sub 24. Other resilient members known to workers in the art, however, such as a series of Bellville or curved washers, may be used instead of a compression spring. Likewise, the invention is not limited to a particular way in which the resilient member is mounted within housing.

The actuation ball seat of the novel stimulation valves is adapted to selectively capture and release balls pumped into the valve so as to allow actuation of the reciprocating shifter. Thus, for example, actuation ball seat 31 in valve 10 is a split ring having tapered upper portions. The gap in split ring allows ring 31 to be radially compressed, and when compressed, the gap is closed allowing ring 31 to form a continuous seat which can receive a ball of a defined diameter that otherwise would pass through ring 31. When shifter sleeve 30 is in its initial upward position as shown, for example, in FIG. 4A, actuation ball seat 31 is radially compressed within an enlarged diameter portion of upper housing sub 23 near the lower end thereof. Being in its compressed state, actuation ball seat 31 will capture a ball pumped into valve 10, such as ball 1.

Figure 6A:
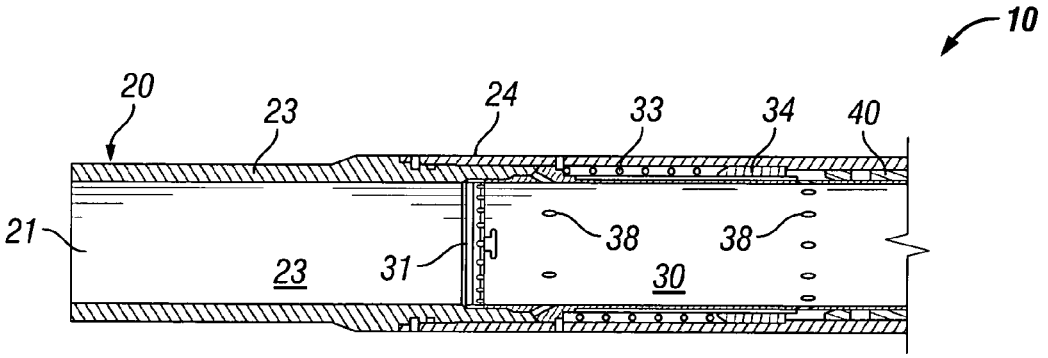
FIGS. 6A to 6C are enlarged axial cross-sectional views similar to the views of FIGS. 4 and 5 showing novel frac valve 10 after an indexed drive sleeve 40 has indexed one unit down frac valve 10 and drop ball 1 is passing though frac valve 10.

Continued pumping of fluid into liner 2 will create hydraulic pressure above ball 1 which urges shifter sleeve 30 downward relative to housing 20. After shifter sleeve 30 has travelled downward a certain distance, actuation ball seat 31 will enter another, further enlarged portion of upper housing sub 23 and will relax and expand as shown, for example, in FIG. 5A. Once it has expanded, ball seat 31 will release ball 1, allowing shifter sleeve 30 to return to its upper, starting position, as shown in FIG. 6A. As shifter sleeve 30 completes its upstroke and returns to its initial position, actuation ball seat 31 will be compressed again so that it is again capable of capturing a ball dropped into valve 10.

The compressible, split rings used to provide actuation ball seat 31 in valve 10 provide a simple, effective mechanism for allowing the selective capture and release of a ball. They also provide an effective seat which allows a captured ball to substantially shut off flow through the seat, which in turn allows hydraulic force to be efficiently created an effectively transferred to an shifter. Any number of similar mechanisms, however, may be used to provide such a ball seat in the novel valves.

A plurality of radially displaceable ring segments or dogs may be used and mounted, for example, in suitably configured slots in shifter sleeve 30. Such segments and dogs would be mounted such that they are urged inward when shifter sleeve 30 is in its upper, initial position, and allowed to be displaced outward when shifter sleeve 30 has completed its down stroke. Shifter sleeve 30 also may be provided with resilient collet fingers that could be compressed to capture a ball and allowed to relax to pass a ball. A ball seat formed of resilient material also may be provided. The resilient material would be selected and molded so as to capture a ball, hold it while sufficient hydraulic force is generated to actuate shifter sleeve, and then release it at higher hydraulic pressures.

It also will be appreciated that the description references drop balls. Spherical balls are preferred, as they generally will be transported though well tubulars and into engagement with downhole components with greater reliability. Other conventional plugs, darts, and the like which do not have a spherical shape, however, also may be used to index and actuate the novel valves. The configuration of the "ball" seats necessarily would be coordinated with the geometry of such devices. "Balls" as used herein, therefore, will be understood to include any of the various conventional plug and actuating devices that are commonly pumped down a well to mechanically actuate mechanisms, even if such devices are not spherical. "Ball" seats is used in a similar manner.

In any event, the actuation ball seat will selectively capture and release a ball to actuate the shifter. The shifter in turn is adapted to engage and drive an indexed driver from an initial position through one or more intermediate positions to a terminal position. When the indexed driver is in the initial and intermediate positions, the valve body will be in a closed position shutting off fluid communication through the housing port. The indexed driver is operatively connected to the valve body such that when it moves to its terminal position the valve body moves from its closed position to its open position. A series of balls, all of the same diameter, therefore, may be passed through the novel valves to first index and then actuate the valve.

Valve 10, for example, comprises indexed drive sleeve 40 and valve sleeve 50. As successive balls are pumped into valve 10, shifter sleeve 30 will engage and release drive sleeve 40, causing it to index, relative to housing 20, from an initial position through various intermediate positions to a terminal position. In particular, shifter sleeve 30 will cause drive sleeve to travel down valve 10 from its run-in position through various intermediate positions remote from valve sleeve 50. Valve sleeve 50, therefore, will remain in its run-in, closed position shutting off flow ports 22 as drive sleeve 40 indexes down valve 10. Once drive sleeve 40 has been fully indexed, the next ball dropped into valve 10 will cause shifter sleeve 30 to urge drive sleeve 40 into engagement with valve sleeve 50, driving valve sleeve 50 downward into its open position to allow flow through ports 22.

Figure 4B:
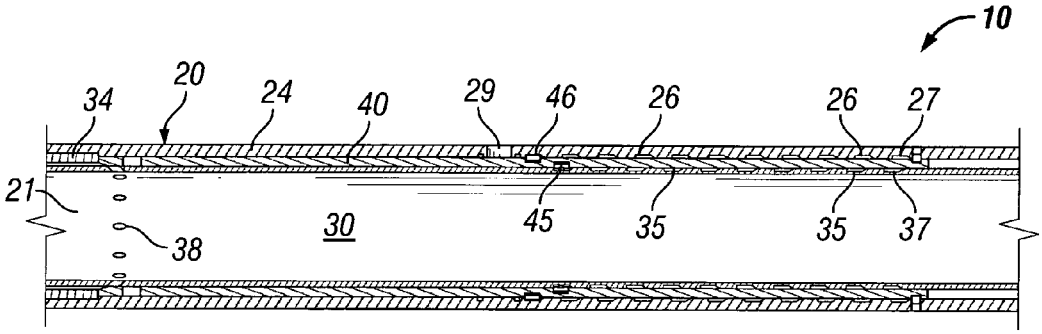
Figure 7A:
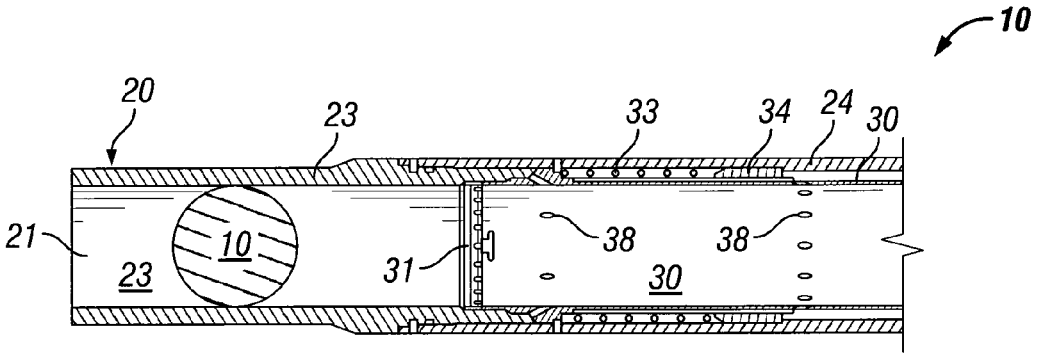
FIGS. 7A to 7C are enlarged axial cross-sectional views similar to FIGS. 4-6 showing novel frac valve 10 after indexed drive sleeve 40 has been fully indexed and a tenth drop ball 10 is approaching actuation ball seat 31.

Thus, as may be seen best by comparing FIGS. 4B to 9B, drive sleeve 40 is a generally cylindrical component that is mounted in the mid-portion of valve 10 for indexed downward movement between shifter sleeve 30 and intermediate housing sub 24. In FIG. 4, drive sleeve 40 is shown in its initial, uppermost position, what may be referred to as index position 1. Shifter sleeve 30 of valve 10 will selectively engage and disengage drive sleeve 40 so as to shift drive sleeve 40 down valve 10 in an indexed manner more or less from one end of shifter sleeve 30 to the other until it is fully indexed, as shown in FIG. 7. Smaller circulation ports, such as ports 38, preferably are provided in shifter sleeve 30 to allow fluid to flow above and below drive sleeve 40 as it travels down valve 10.

Thus, the novel stimulation valves preferably comprise two ratchet mechanisms: one ratchet mechanism allowing the drive sleeve to index relative to the housing, and the other ratchet mechanism allowing the drive sleeve to index relative to the reciprocating shifter. The ratchet mechanisms may include pawls, such as split rings, radially reciprocating dogs, and collet fingers, that ride in and out of detents, such as annular grooves or recesses. The pawls may be provided or mounted on the drive sleeve and detents in the housing and shifter sleeve, or vice versa. Various ratchet mechanisms are known in the art and may be adapted for use in the novel valves.

For example, as may be seen best in FIGS. 4B to 9B, valve 10 has a pair of split pawl rings: an inner pawl ring 45 disposed between shifter sleeve 30 and drive sleeve 40 and an outer pawl ring 46 disposed between drive sleeve 40 and intermediate housing sub 24. More particularly, pawl rings 45 and 46 are received in annular retaining grooves situated near the upper end of drive sleeve 40. A series of 10 annular detent grooves 26 are provided in the inner surface of intermediate housing sub 24. A similar series of 9 annular detent grooves 35 are provided in the outer surface of shifter sleeve 30. As will be appreciated from the discussion that follows, however, more or fewer detent grooves 26 and 35 may be provided.

The upper edges of detent grooves 26 and 35 are shouldered, while the lower edges are ramped. Thus, for example, when ball 1 lands on ball seat 31 of shifter sleeve 30 and urges it downward, inner pawl ring 45 will engage the shouldered edge of uppermost detent groove 35 in shifter sleeve 30, causing shifter sleeve 30 to pick up and carry drive sleeve 40 as it completes its down stroke. Detent grooves 26 in intermediate housing sub 24, however, have a downwardly extending ramp. Thus, as shifter sleeve 30 carries drive sleeve 40 downward, outer pawl ring 46 will ride out of uppermost detent groove 26 in intermediate housing sub 24 allowing drive sleeve 40 to travel downwardly relative to housing 20.

Figure 5B:
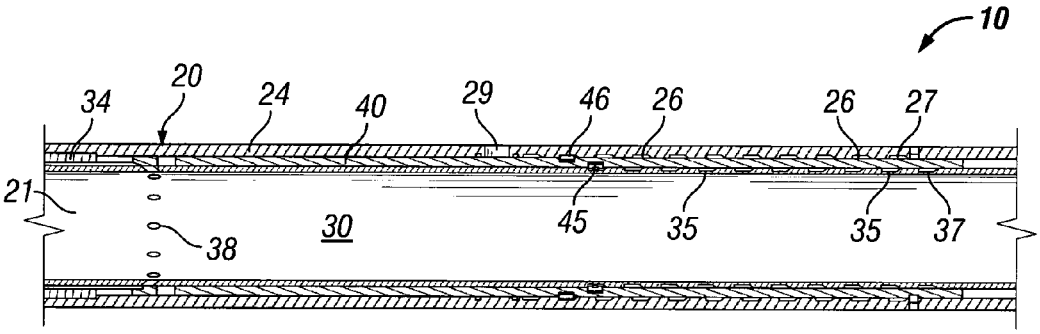
Figure 6B:
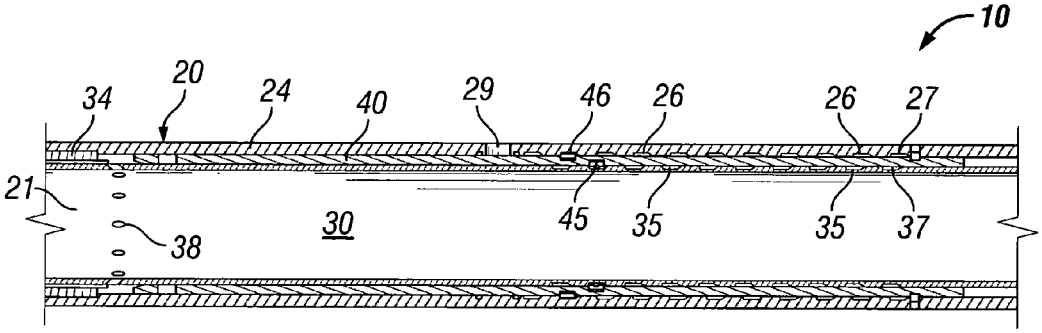

When shifter sleeve 30 has completed its downward stroke and ball seat 31 has released ball 1, outer pawl ring 46 will have moved into the next detent groove 26 in intermediate housing sub 24, as best appreciated by comparing FIGS. 4B and 5B. At that point, spring 33 will urge shifter sleeve 30 upwards back toward its initial position. Outer pawl ring 46, however, will engage the shouldered edge of detent groove 26 in intermediate housing sub 24, while inner pawl ring 45 is compressed by upper edges of detent groove 35 in shifter sleeve 30. That engagement prevents drive sleeve 40 from being carried back upwards by shifter sleeve 30 as it returns to its original position relative to housing 20, as best appreciated by comparing FIGS. 5B and 6B.

Thus, as shifter sleeve 30 reciprocates through its down stroke and upstroke, drive sleeve 40 will be indexed down one unit relative to both shifter sleeve 30 and housing 20. For example, as ball 1 is pumped through valve 10 drive sleeve 40 will be indexed from its initial position or index position 1, as shown in FIG. 4, to a first intermediate position, what may be referred to as index position 2, as shown in FIG. 6. Moreover, ball seat 31 of shifter sleeve 30 will continue to capture and release successive balls, indexing drive sleeve 40 additional units, until drive sleeve 40 is fully indexed. That is best appreciated by reference to FIG. 7B, which shows valve 10 in what may be referred to as index position 10 after ball 9 (not shown) has passed through valve 10. As drive sleeve 40 is indexed down valve 10 it also will be appreciated that balls 1 through 9, which actuate shifter sleeve 30 and index drive sleeve 40, will pass through valve 10 without opening flow ports 22 in intermediate housing sub 24.

That is, the valve body of the novel stimulation valves is adapted to shut off or to allow fluid flow through the port in the valve housing and preferably to carry the isolation ball seat. Thus, for example, valve sleeve 50 in valve 10 is a generally cylindrical sleeve mounted within intermediate housing sub 24, as may be seen generally in FIG. 3. As shown in greater detail in FIGS. 4C to 9C, valve sleeve 50 has a number of ports 52. The arrangement and size of ports 52 are generally coordinated with ports 22 in intermediate housing sub 24. Thus, valve sleeve 50 is provided with two longitudinally spaced sets of radially arranged ports 52.

Figure 4C:
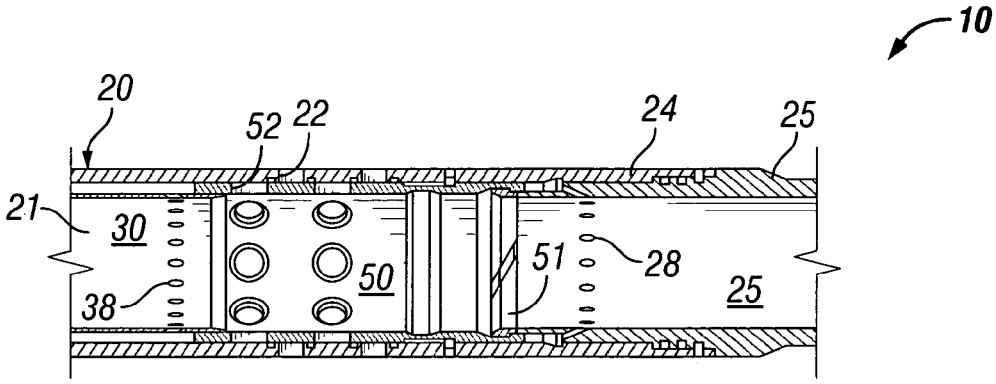
Figure 5C:
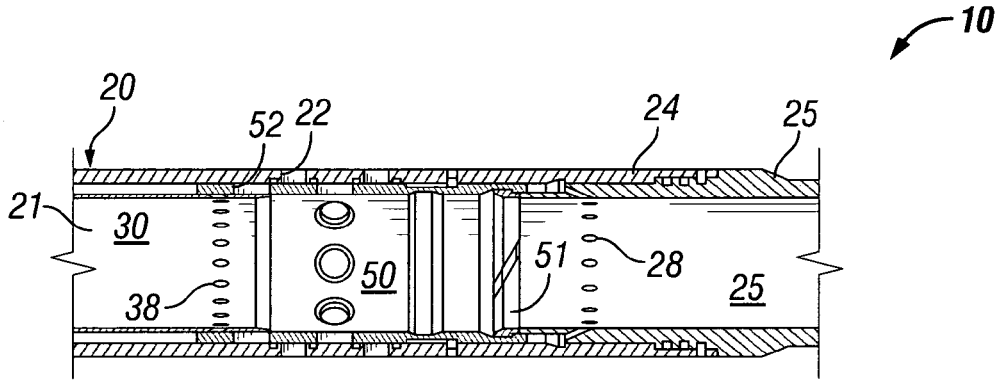
Figure 6C:
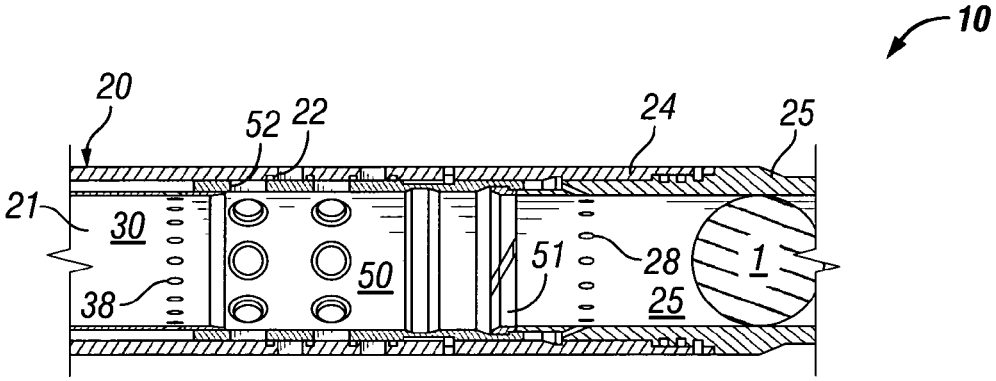

When valve sleeve 50 is in its initial, run-in position as shown in FIG. 4C, valve ports 52 are offset from flow ports 22 in intermediate housing sub 24. Fluid flow between central conduit 21 to the exterior of housing 20 is shut off. It also will be appreciated that valve sleeve 50 remains in its initial shut position as balls 1 to 9 are pumped through valve 10 to index drive sleeve 40, as may be appreciated by comparing FIGS. 4C through 7C.

The isolation ball seats of the novel stimulation valves are adapted to selectively pass or capture a ball so as to isolate portions of a tubular below the valve from fluid pumped into the tubular. As is the case for the actuation ball seat, a number of conventional mechanisms such as displaceable dogs or rings segments, resilient collet fingers, or resilient formed seats may be used.

For example, as may be seen generally in FIG. 3 and in greater detail in FIGS. 4C to 9C, valve 10 is provided with an isolation ball seat 51. Isolation ball seat 51 is mounted toward the lower end of valve sleeve 50 in the lower portion of valve 10. Like actuation ball seat 31, isolation ball seat 51 is a split ring having tapered upper edges upon which a ball may seat. When balls 1 through 9 are dropped, valve sleeve 50 remains in its shut position and isolation ball seat 51 remains in its initial, expanded state. Balls 1 through 9, therefore, are allowed to pass through isolation ball seat 51 and out the other end of valve 10, as will be appreciated from FIG. 6C which shows ball 1 exiting valve 10.

Once the indexed driver has been fully indexed, that is, it has moved from its initial position to its last intermediate position, another ball, ball 10 for example, may be pumped into valve 10 as shown in FIG. 7. Shifter sleeve 30 is in its upper position and actuation ball seat 31 is compressed. Inner pawl ring 45 has moved into an engagement groove 37 in shifter sleeve 30 below detent grooves 35, both edges of which are shouldered, thus locking shifter sleeve 30 and drive sleeve 40 together. Ball 10, therefore, will land on actuation ball seat 31, urging shifter sleeve 30 and drive sleeve 40 downward. Outer pawl ring 46 will move into an engagement groove 27 in intermediate housing sub 24, both edges of which are shouldered, thus locking drive sleeve 40 to intermediate housing sub 24 relative to both upward and downward movement. Thus, when shifter sleeve 30 completes its down stroke, it will be held in that position by inner pawl ring 45.

As shifter sleeve 30 and drive sleeve 40 move through their down stroke, drive sleeve 40 engages and drives valve sleeve 50 downward. Smaller circulation ports, such as ports 28, preferably are provided in lower housing sub 25 to allow fluid displaced by the downward travel of valve sleeve 50 to flow into conduit 21. In any event, as valve sleeve 50 is driven down, ports 52 in valve sleeve 50 align with flow ports 22 in intermediate housing sub 24. Fluids may thereafter flow from central conduit 21 through ports 22 and 52 to the exterior of valve 10.

Figure 8A:
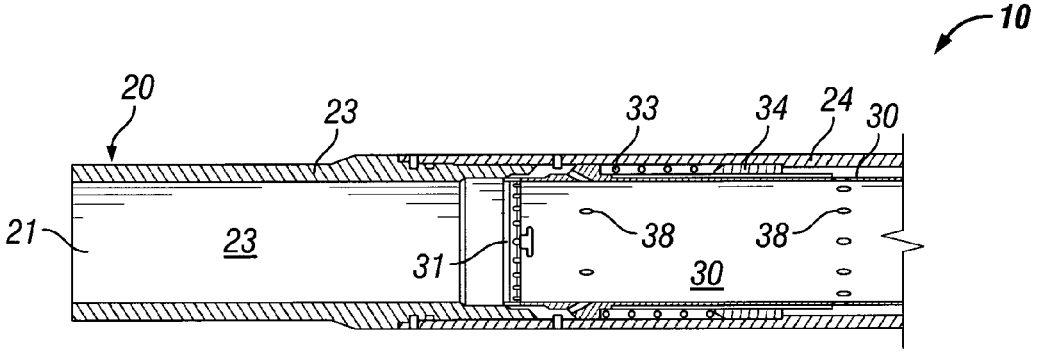
FIGS. 8A to 8C are enlarged axial cross-sectional views similar to FIGS. 4-7 showing novel frac valve 10 after drop ball 10 has seated in an isolation ball seat 51 in a valve sleeve 50 and opened ports 22 in valve 10.
Figure 9A:
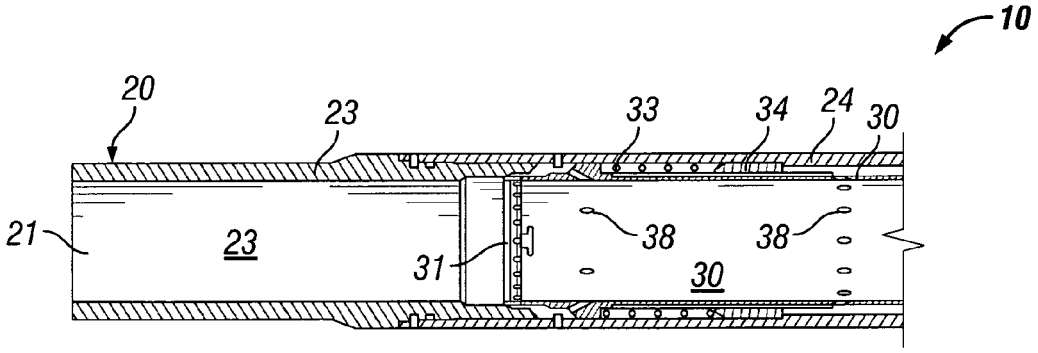
FIGS. 9A to 9C are enlarged axial cross-sectional views similar to FIGS. 4-8 showing novel frac valve 10 after drop ball 9 has displaced and flowed back past isolation ball seat 51 in valve sleeve 50.
Figure 7B:
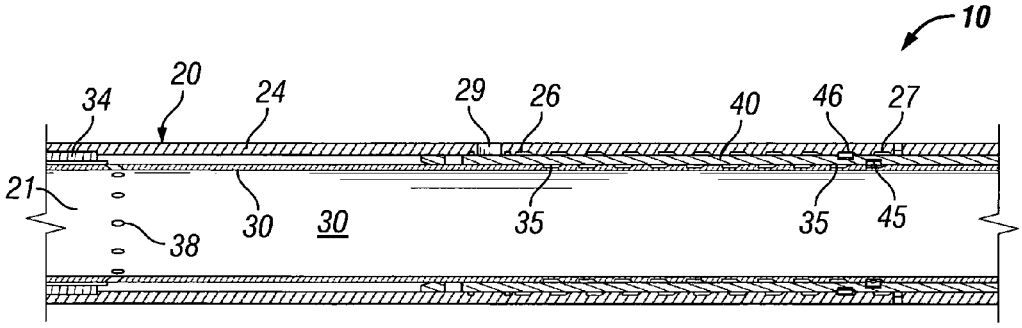
Figure 8B:
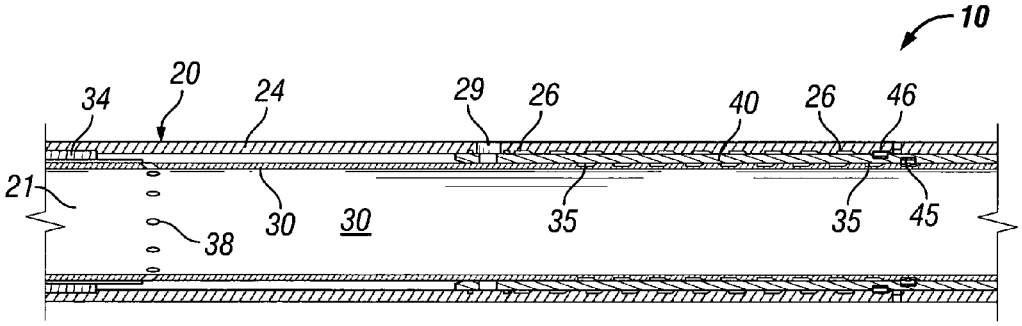
Figure 9B:
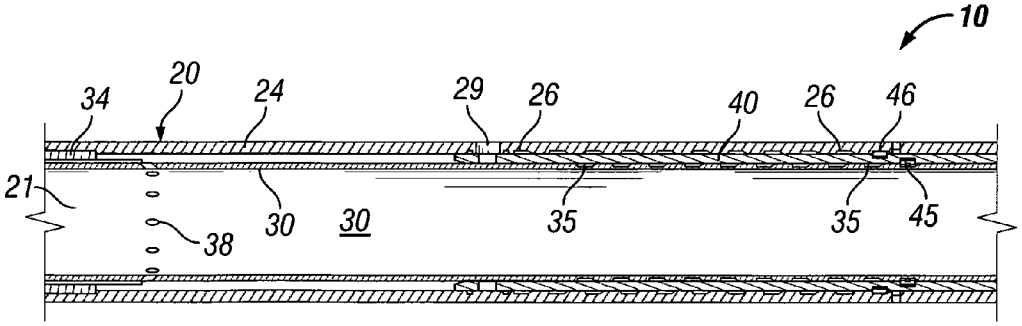
Figure 7C:
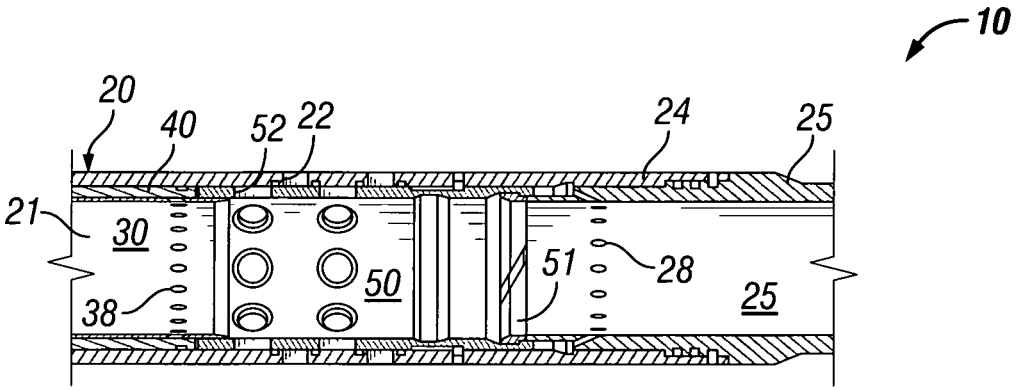
Figure 8C:
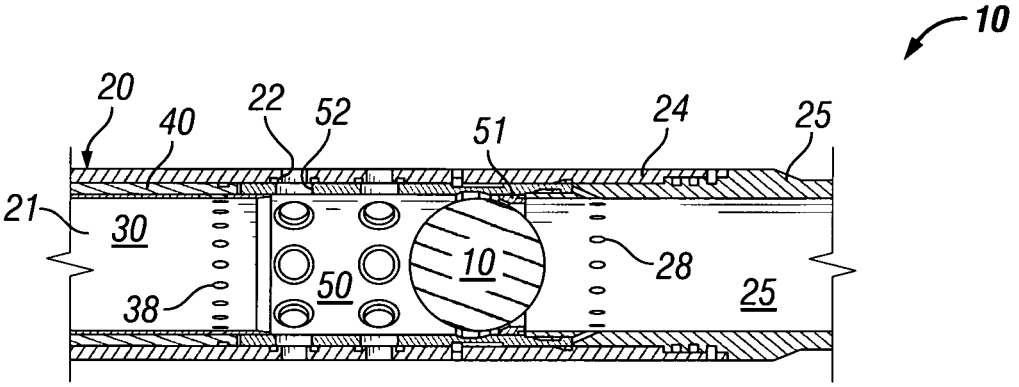

The c-ring or another similar isolation ball seat preferably is mounted for compression such that it will capture a ball. Thus, for example, valve sleeve 50 also compresses isolation ball seat 51 as it is driven down. That is, isolation ball seat 51 rests against the upper portion of lower housing sub 25. As valve sleeve 50 is driven downward, it will ride under isolation ball seat 51. A reduced diameter portion of valve sleeve 50 will ramp under isolation ball seat 51, compressing it. Thus, when actuation ball seat 31 releases ball 10 at the end of the down stroke of shifter sleeve 30, ball 10 will land on isolation ball seat 51, as is shown in FIG. 8C. At that point, ball 10 will isolate those portions of production liner 2 below valve 10 and allow frac fluids to be forced out of valve 10 through flow ports 22 into the adjacent formation.

As noted above, one or more balls may be used to index the novel valves before a ball of the same size is used to actuate the valve and open the flow ports. Those balls used to index the novel valves, as discussed below, will pass through the valve and index or actuate downstream valves in the tubular. Eventually, however, those balls preferably would have be drilled out or allowed to flow back out of the well to allow efficient flow of hydrocarbons up the production liner. Thus, the novel valves preferably include mechanisms to allow balls flowing up through the valves to pass through the isolation ball seat.

Figure 9C:
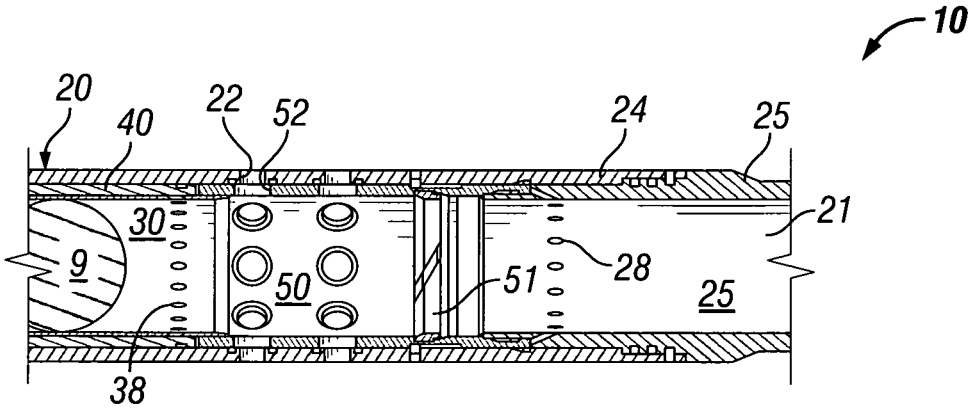

For example, as best appreciated from FIGS. 8C and 9C, isolation ball seat 51 may be displaced by a ball flowing up through valve 10 and allowed to expand. That is, when valve sleeve 50 has moved into its open position, isolation ball seat 51 is resting on a reduced diameter portion of valve sleeve 50 as shown in FIG. 8C. Once production is allowed to flow up production liner 2, ball 10 will flow up through valve 10. Shifter sleeve 30 is locked in its lower position and actuation ball seat 31 is expanded. Ball 10, therefore, is able to flow out the upper end of valve 10. As ball 9 flows up production liner 2 from a downstream valve, it will enter valve 10, dislodge isolation ball seat 51 and urge it upwards into an area of enlarged diameter in valve sleeve 50. Isolation ball seat 51 then is able to expand and allow ball 9 to flow out of valve 10, as will be appreciated from FIG. 9C. At that point, other balls used to actuate valves further downstream of valve 10 will be able to flow unimpeded through valve 10.

As noted above, the advantages derived from the novel valves perhaps are best appreciated in the context of large, multi-stage fracking operations, especially when the liner is cemented in place prior to fracking. Embodiments of the subject invention, therefore, also are directed to methods of fracturing formations in a well bore using the novel frac valves.

A typical multi-stage fracking operation will start by making up a production liner containing a series of valves. The novel valves make it possible to incorporate a relatively large number of valves into a production liner or other tubular and, therefore, to fracture a formation in a relatively large number of stages. Thus, as will be appreciated from FIG. 1, a first series of valves 10*a* to 10*j* (not all of which are shown) may be incorporated into production liner 2 just upstream of an initiator frac valve (not shown) situated in production liner 2 near the toe of well bore 8. A second series of valves 10*q* to 10Z (not all of which are shown) may be incorporated upstream of the first series of valves 10*a*-10*j*.

The actuation ball seat 31 and isolation ball seat 51 in the first series of valves 10*a* to 10*j* all are the same size, so that valves 10*a* to 10*j* may be indexed and actuated by balls of the same size. Valves 10*a* to 10*j*, however, will be indexed to different degrees at the surface before they are installed in production liner 2. Valve 10*a*, the lowermost valve, will be fully indexed (in index position 10) as shown in FIG. 7 so that the first ball pumped into production liner 2 will actuate valve 10*a* and open its flow ports 22 (as shown in FIG. 8). Valve 10*b*, the next valve up production liner 2 from valve 10*a*, will be in index position 9. That is, it will be pre-indexed one unit less than valve 10*a*. The first ball passing through valve 10*b*, therefore, will index valve 10*b* one unit (to index position 10) and the next ball will actuate it. Valves 10*c* to 10*j* are each pre-indexed to progressively lesser degrees, from index positions 8 to 1, before they are installed in production liner 2, valve 10*j* being unindexed (in index position 1) as shown in FIG. 4.

Valves 10*q* to 10*z* also share a common sized actuation ball seat 31 and isolation ball seat 51, but those seats are sized to pass or capture a slightly larger ball than that which is used to index and actuate valves 10*a* to 10*j*. Valves 10*q* to 10*z*, however, are similarly pre-indexed before incorporation into production liner 2, valve 10*q* being fully pre-indexed and valve 10*z* being unindexed. In this regard, it will be appreciated that the novel valves preferably comprise some means to readily determine the degree to which a valve has been pre-indexed before it is incorporated into a production liner or other tubular. Thus, for example, drive sleeve 40 of valve 10 has a series of numbers etched in its outer surface which may be viewed through sight hole 29, each number corresponding to a particular index position. This may be best appreciated from FIG. 2, which shows the figure "1" visible through sight hole 29, indicating that drive sleeve 40 of valve 10 is in index position 1, its uppermost, unindexed position.

Liner 2 then may be run into a well bore and installed near the lower end of host casing 4, for example, by a liner hanger 5. Valves 10 will be in their closed, run in position. If the frac job will be performed on an open hole, the production liner also will incorporate a series of packers that will be set to seal off and isolate various zones in the well bore. If not, the liner will be cemented in place by pumping a plug of cement down the production liner, out the bottom of the liner, and into the annulus between the liner and well bore. The cement will be allowed to harden and encase the liner, for example, as shown in FIG. 1, where cement 7 has encased production liner 2.

Installing a liner or other well tubular with the novel frac valves may be performed by conventional methods and utilizing any number of widely available tools and supplies as are used in installing conventional liners and tubulars. It will be appreciated, however, that in cementing the well it is essential to ensure that cement is pumped completely through the liner. Even small amounts of cement hung up in a liner may harden and interfere with the operation of equipment in the liner. Thus, wiper darts, plugs or the like (not shown) will be used to push cement through a liner and ensure that the internal conduit is wiped clean of any residual concrete that may impede flow of hydrocarbons or interfere with the operation of liner equipment.

In any event, once liner 2 has been installed, hydraulic pressure will be increased in production liner 2 to open the initiator frac valve, fracture the first zone near the toe of well bore 8, and to established flow into production liner 2. Valves 10 then may be indexed and actuated by pumping balls through production liner 2. More specifically, ball 1 is dropped into production liner 2. Since it is too small to be captured in actuation seat of valves 10*q* to 10*z*, it will pass through valves 10*q* to 10*z* without either actuating or indexing them. As it continues down production liner 2, however, it will index valves 10*b* to 10*j*. When ball 1 enters valve 10*a* it will land first on actuation ball seat 31 to open flow ports 22 and then on isolation ball seat 51 to allow fracturing of the adjacent zone.

Ball 2 then may be pumped into production liner 2. It will pass through valves 10*q* to 10*z*, index valves 10*c* to 10*j*, and actuate valve 10*b*. The zone adjacent valve 10*b* then will be fractured, and successive balls dropped until each of valves 10*c* to 10*j* have been actuated and their adjacent zones fractured. Larger balls then will be dropped in succession to index and actuate valves 10*q* to 10*z*, until each of those valves 10 have been actuated and their adjacent zones fractured.

It will be appreciated, therefore, that while they may be used in wells where only a few zones will be fractured, the novel frac valves are particularly suited for incorporation into production liners or other tubulars where a large number of zones will be individually fractured. As described above, twenty zones may be individually fractured using two series of novel frac valves 10 and only two sizes of drop balls. Additional series of valves using additional sizes of drop balls may be installed in a production liner to allow even more zones to be individually fractured. Similarly, frac valves 10 may be configured to incorporate more or fewer index positions, by shortening or lengthening indexed drive for example. An isolation seat may be removed from an uphole valve so that the zone adjacent the uphole valve may be stimulated at the same time a lower zone is stimulated via a downhole valve. Thus, the novel valves not only allow fracturing to proceed over an extended distance in a large number of stages, but they allow great flexibility in fracturing the well.

The novel frac valves also are well suited for use in wells in which the production liner will be cemented in the well bore before the formation is fractured, for example, as shown schematically in FIG. 1. That is, if a production liner is cemented in the well bore, cement necessarily will be passed through any frac valves incorporated into the liner. Even small amounts of cement hung up in a valve, however, may harden and interfere with the operation of the valve. Wiper darts may not be able to effectively remove cement from many prior art valves if they have, as many do, various profiles and recesses in the central conduit.

The central conduit of the novel stimulation valves, however, can and preferably is provided with a substantially uniform internal diameter which is relatively free of profiles. For example, by mounting the primary components of valve 10, such as shifter sleeve 30, drive sleeve 40, and valve sleeve 50, within an enlarged, inner diameter portion of housing 20, those components may be situated and configured to avoid any constriction in central conduit 21. Shifter sleeve 30, for example, preferably has an inner diameter substantially equal to the diameter of upper housing sub 23 and lower housing sub 25. While the inner diameter of valve sleeve 50 is generally somewhat larger, the substantial length of conduit 21 has a uniform diameter from which a wiper plug may more effectively remove cement.

Moreover, the areas into which the indexed mechanism travels may be and preferably are substantially isolated from the central conduit. For example, in valve 10 shifter sleeve 30 is an elongated, substantially continuous sleeve extending completely over drive sleeve 40 and the area within housing 20 through which it travels. Shifter sleeve 30 also extends over one end of valve sleeve 50, the other end of valve sleeve 50 extending under the upper portion of lower housing sub 25. Thus, the areas into which drive sleeve 40 and valve sleeve 50 will move as valve 10 is indexed and actuated are substantially isolated from conduit 21 and, in particular, cement passed through conduit 21.

It will be noted that the novel sleeves also preferably incorporate additional components to further isolate travel areas from cement passing through the central conduit. Circulation ports 38 in shifter sleeve 30, for example, preferably incorporate burst discs (not shown) and the like that prevent the ingress of cement during installation of the liner, but will burst upon actuation of drive sleeve 40 allowing fluid in conduit 21 to flow around drive sleeve 40 as it moves. Circulation ports 28 in lower housing sub 25 and ports 52 in valve sleeve 50 also may incorporate burst discs (not shown). In addition, flow ports 22 in intermediate housing sub 24 preferably are likewise protected from the outside, for example, by a thin polymer sleeve 53 fitting over the lower portion of intermediate housing sub 24 as seen best in FIG. 2. Thus, the novel frac valves may be and preferably are configured to make them more suitable for use when the production liner will be cemented in the well.

Figure 10A:
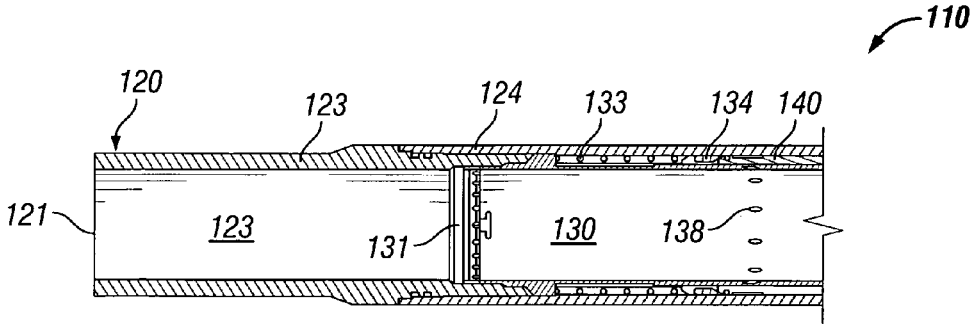
FIG. 10A is an enlarged axial cross-sectional view of the upper portion (corresponding generally to upper portion A of frac valve 10 shown in FIG. 3) of a second preferred embodiment 110 of the novel stimulation valves showing frac valve 110 in its closed or run-in position.
Figure 10B:
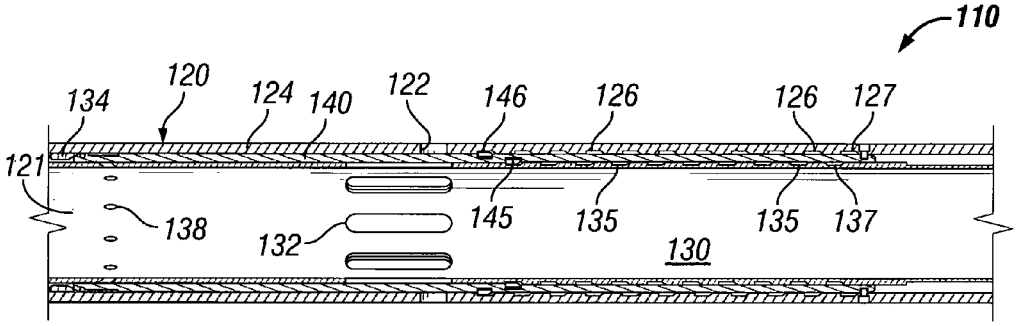
FIG. 10B is an enlarged axial cross-sectional view of the mid portion (corresponding generally to mid portion B of frac valve 10 shown in FIG. 3) of frac valve 110.
Figure 10C:
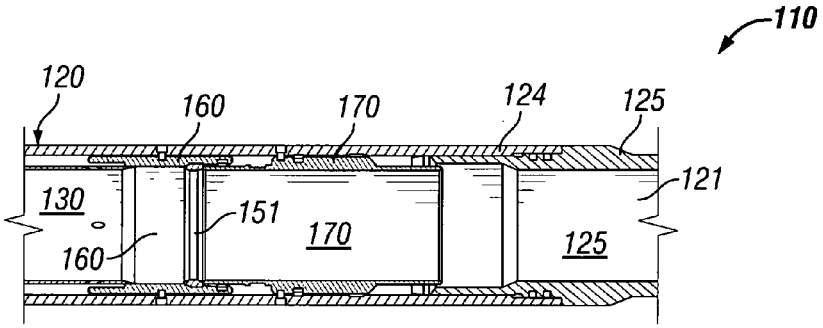
FIG. 10C is an enlarged axial cross-sectional view of the lower portion (corresponding generally to lower portion C of frac valve 10 shown in FIG. 3) of frac valve 110.

A second preferred frac valve 110 is illustrated in FIG. 10. Frac valve 110 is similar in many respects to valve 10 and may be used and operated in a production liner in substantially the same manner as valve 10. More particularly, as may be seen in FIG. 10, frac valve 110 generally comprises a housing 120, an actuation ball seat 131, a reciprocating shifter sleeve 130, an indexed drive sleeve 140, a compression sleeve 160, and a backup sleeve 170. Housing 120, like housing 20, comprises an upper housing sub 123, an intermediate housing sub 124, and a lower housing sub 125, and otherwise is quite similar thereto. Intermediate housing sub 124 is provided with a plurality of flow ports 122, like intermediate housing sub 124, and has an enlarged internal diameter relative to upper housing sub 123 and lower housing sub 125. The principle differences between housing 20 and housing 120 relate to various details by which the other components are mounted therein.

Actuation ball seat 131 is mounted on the upper end of reciprocating shifter sleeve 130. Shifter sleeve 130 is substantially similar to shifter sleeve 30 in valve 10. It is mounted for reciprocating movement within housing 120 and is biased upwards by a resilient member, such as a compression spring 133. Shifter sleeve 130, however, is provided with a plurality of ports 132 more or less aligned with flow ports 122 in intermediate housing sub 124.

Actuation ball seat 131 is substantially identical to actuation ball seat 31 in valve 10. It is a split ring mounted under compression and can selectively capture and release balls pumped into valve 110 to actuate shifter sleeve 130. More specifically, actuation ball seat 131 is able to expand into an enlarged portion of upper housing sub 123 when shifter sleeve 130 has completed its down stroke and will be compressed again by upper housing sub 123 as shifter sleeve 130 completes its upstroke back to its initial position.

As in valve 10, shifter sleeve 130 is adapted to engage and, drive indexed drive sleeve 140 through various index positions. A pair of split pawl rings are provided, an inner pawl ring 145 disposed between shifter sleeve 130 and drive sleeve 140 and an outer pawl ring 146 disposed between drive sleeve 140 and intermediate housing sub 124. Outer pawl ring 146 rides in and out of annular detent grooves 126 in intermediate housing sub 124, and inner pawl ring 145 rides in and out of annular detent grooves 135 in shifter sleeve 130 as shifter sleeve 130 reciprocates. Drive sleeve 140, therefore, will travel down valve 110 one index position at a time.

In contrast to valve 10, however, indexed drive sleeve 140 in valve 110 also serves as a valve body. That is, when drive sleeve 140 is in its initial position and intermediate positions, it covers flow ports 122 in intermediate housing sub 124. When it moves into its terminal position, it has traveled past flow ports 122, uncovering them in the process. Fluid thus is able to flow out of conduit 121 via ports 132 in shifter sleeve 130 and flow ports 122 in intermediate housing sub 124. Alternatively, ports may be provided in drive sleeve 140 which align with ports 132 and flow ports 122 when drive sleeve 130 has reached its terminal position. In either event, by essentially fabricating an indexed driver and valve body as a single component, or by otherwise joining them together, the components are operatively connected so that the valve body moves from its closed position to its open position as the indexed driver moves to its terminal position.

Isolation ball seat 151, like isolation ball seat 51 in valve 10, is a split ring which is adapted to allow balls to pass as valve 110 is indexed, but to capture a ball once flow ports 122 have been opened. In contrast to isolation ball seat 51 of valve 10, however, isolation ball seat 151 is mounted in compression sleeve 160. Compression sleeve 160 is mounted for linear movement within intermediate housing sub 124, and isolation ball seat 151 is mounted toward the lower end of compression sleeve 160. As drive sleeve 140 moves into its terminal position opening flow ports 122, it also will engage and drive compression sleeve 160 downward. Isolation ball seat 151 rests against backup sleeve 170 which is mounted in intermediate housing sub 124. As compression sleeve 160 is driven downward, its lower portion will move around the upper portion of backup sleeve 170 and engage backup sleeve 170 via, for example, a split lock ring. At the same time, a reduced diameter portion of compression sleeve 160 will ramp under isolation ball seat 151, compressing it and allowing it to capture a ball.

Once a ball lands on isolation ball seat 151, fluid pressure will urge backup sleeve 170 and compression sleeve 160 downward until backup sleeve 170 bottoms against lower housing sub 125. Once production begins, balls are able to pass upwards through valve 110 in a manner similar to what occurs in valve 10. The first ball passing up through valve 110 will impact isolation ball seat 151 and displace it into an area of enlarged diameter on compression sleeve 160 above the reduced diameter area upon which isolation ball seat 151 was resting. Isolation ball seat 151 then is able to expand and allow balls to flow up through valve 110.

Figure 11A:
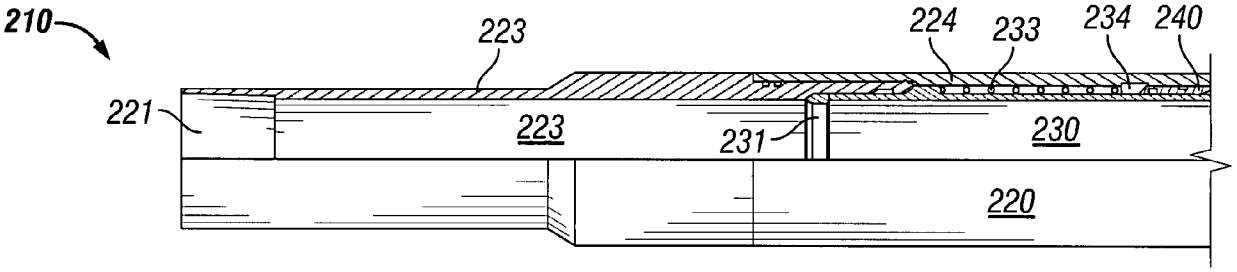
FIG. 11A is an enlarged axial cross-sectional view of the upper portion (corresponding generally to upper portion A of frac valve 10 shown in FIG. 3) of a third preferred embodiment 210 of the novel stimulation valves showing frac valve 210 in its closed or run-in position.
Figure 11B:
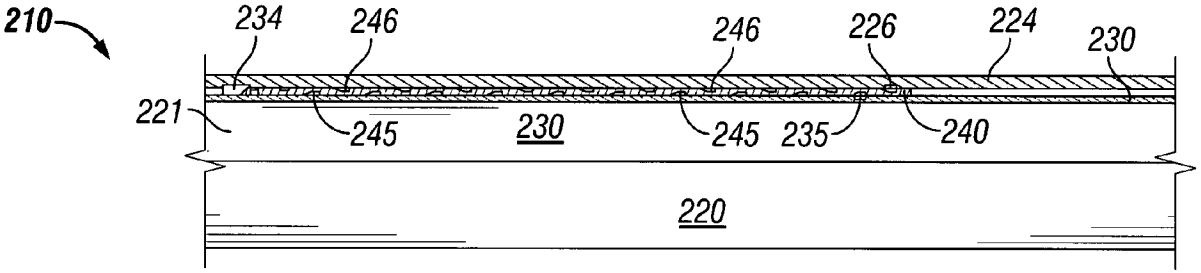
FIG. 11B is an enlarged axial cross-sectional view of the mid portion (corresponding generally to mid portion B of frac valve 10 shown in FIG. 3) of frac valve 210.

A third preferred frac valve 210 is illustrated in FIG. 11. Frac valve 210 is similar in many respects to valves 10 and 110 and may be used and operated in a production liner in substantially the same manner as valves 10 and 110. More particularly, as may be seen in FIG. 11, frac valve 210 generally comprises a housing 220, an actuation ball seat 231, a reciprocating shifter sleeve 230, an indexed drive sleeve 240, a valve sleeve 250, and a compression sleeve 260. As in valves 10 and 110, housing 220 comprises an upper housing sub 223, an intermediate housing sub 224, and a lower housing sub 225 and is quite similar to housings 20 and 120. Intermediate housing sub 224 is provided with a plurality of flow ports 222 and has an enlarged internal diameter relative to upper housing sub 223 and lower housing sub 225. The principle differences between housing 220 and housings 20 and 120 relate to various details by which the other components are mounted therein.

Actuation ball seat 231 is mounted on the upper end of reciprocating shifter sleeve 230. Shifter sleeve 230 is substantially similar to shifter sleeves 30 and 130 in, respectively, valve 10 and valve 110. It is mounted for reciprocating movement within housing 220 and is biased upwards by a resilient member, such as compression spring 233. Shifter sleeve 230, however, is provided with a plurality of ports 232 more or less aligned with flow ports 222 in intermediate housing sub 224. Actuation ball seat 231 is substantially identical to actuation ball seat 31 and 131 in valves 10 and 110. It is a split ring mounted under compression and can selectively capture and release balls pumped into valve 210 to actuate shifter sleeve 230.

As in valves 10 and 110, shifter sleeve 230 is adapted to engage and drive indexed drive sleeve 240 through various index positions. It uses similar ratcheting mechanisms including an inner pawl ring 235 disposed between shifter sleeve 230 and drive sleeve 240 and an outer pawl ring 246 disposed between drive sleeve 240 and intermediate housing sub 224. The ratchet mechanisms, however, are reversed. That is, outer pawl ring 226 is mounted in intermediate housing sub 224 and rides in and out of annular detent grooves 246 in the outer surface of drive sleeve 240, and inner pawl ring 235 is mounted in shifter sleeve 230 and rides in and out of annular detent grooves 245 in the inner surface of drive sleeve 240 as shifter sleeve 230 reciprocates. Drive sleeve 240, therefore, will travel down valve 210 one index position at a time.

Figure 11C:
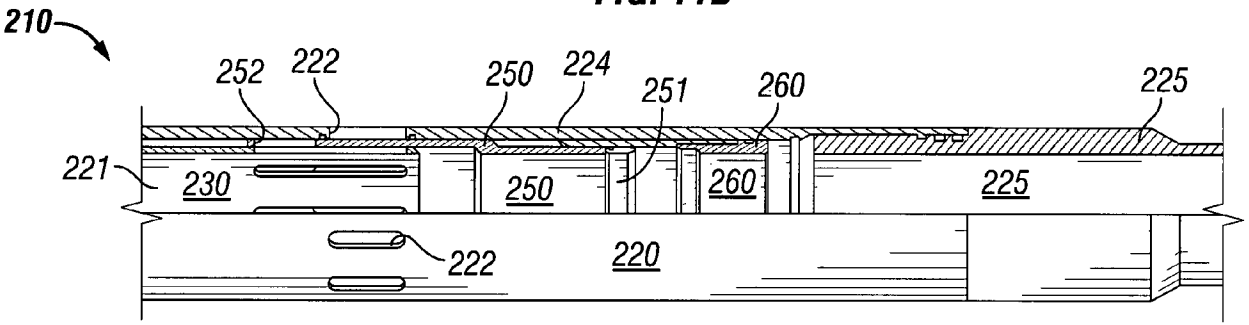
FIG. 11C is an enlarged axial cross-sectional view of the lower portion (corresponding generally to lower portion C of frac valve 10 shown in FIG. 3) of frac valve 210.

Valve sleeve 250, like valve sleeve 50 in valve 10, is adapted to shut off or to allow fluid flow through flow ports 222 in intermediate housing sub 224. It has a number of valve ports 252 which, when valve sleeve 250 is in its initial, run-in position as shown in FIG. 11C, are offset from flow ports 222 in intermediate housing sub 224 and flow from central conduit 221 to the exterior of housing 220 is shut off. Valve sleeve 250 remains in its initial shut position as balls are pumped through valve 210 to index drive sleeve 240. When drive sleeve 240 is fully indexed, as in valve 10, it will actuate valve sleeve 250 and move it from its shut position to its open position, in which open position valve ports 252 are aligned with flow ports 222 in intermediate housing sub 224 and ports 232 in shifter sleeve 230.

Isolation ball seat 251, like isolation ball seat 51 and 151 in valve 10 and valve 110, is a split ring which is adapted to allow balls to pass as valve 210 is indexed, but to capture a ball once flow ports 222 have been opened. Like isolation ball seat 51 of valve 10, isolation ball seat 251 is mounted in valve sleeve 250. Isolation ball seat 251, however, is releasably mounted at the lower end of valve sleeve 250 via, for example, mating annular bosses on the upper end of isolation ball seat 251 and the lower end of valve sleeve 250. As drive sleeve 240 engages valve sleeve 250 and urges it downward to open flow ports 222, isolation ball seat 251 will be driven into compression sleeve 260 which has a smaller inner diameter relative to the outer diameter of isolation ball seat 251. Thus, as it is urged into compression sleeve 260, ball seat 251 will compress allowing it to capture a ball.

Once a ball lands on isolation ball seat 251, fluid pressure will urge compression sleeve 260 downward until it bottoms against lower housing sub 225 and locks with intermediate housing sub 224. Once production begins, balls are able to pass upwards through valve 210 in a manner similar to what occurs in valve 10 and 110. The first ball passing up through valve 210 will impact isolation seat 251 and displace it off compression ring 260 into an area of enlarged inner diameter. Isolation ball seat 251 then is able to expand and allow balls to flow up through valve 210.

Figure 12A:
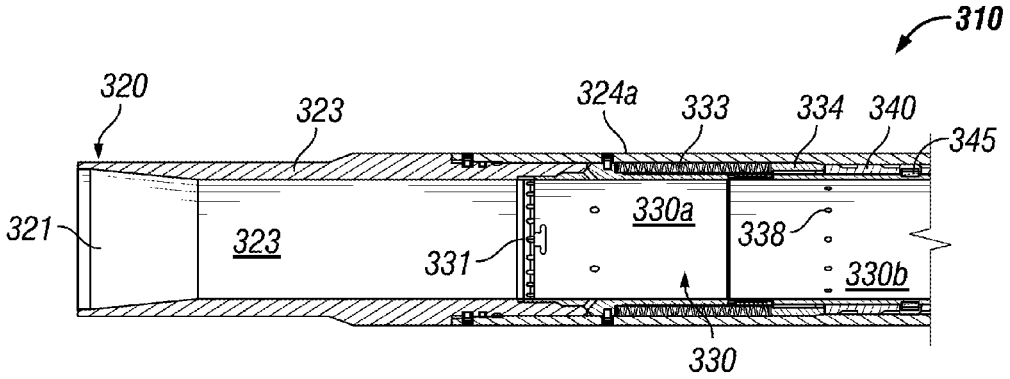
FIG. 12A is an enlarged axial cross-sectional view of the upper portion (corresponding generally to upper portion A of frac valve 10 shown in FIG. 3) of a forth preferred embodiment 310 of the novel stimulation valves showing frac valve 310 in its closed or run-in position.
Figure 12B:
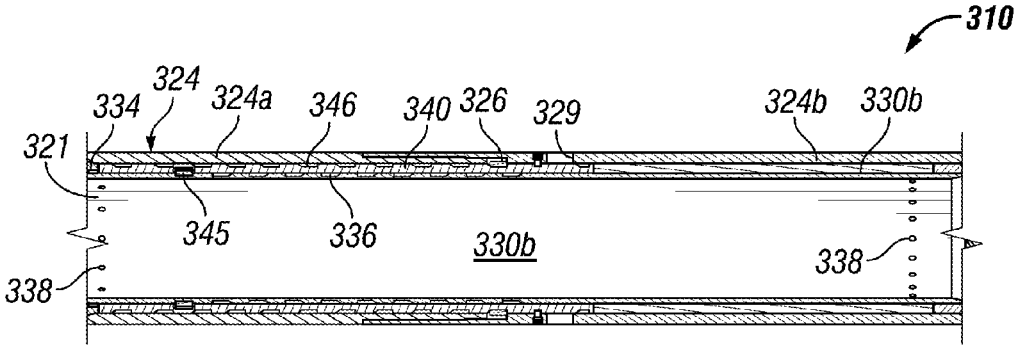
FIG. 12B is an enlarged axial cross-sectional view of the mid portion (corresponding generally to mid portion B of frac valve 10 shown in FIG. 3) of frac valve 310.

A fourth preferred frac valve 310 is illustrated in FIG. 12. Frac valve 310 is similar in many respects to the other exemplified valves and may be used and operated in a tubular in substantially the same manner. More particularly, as may be seen in FIG. 12, frac valve 310 generally comprises a housing 320, an actuation ball seat 331, a reciprocating shifter sleeve 330, an indexed drive sleeve 340, a valve sleeve 350, and an isolation seat 351. Housing 320 is similar to housings 20, 120, and 220 in valves 10, 110, and 210, except that intermediate housing sub 324 comprises two separate components to further improve the assembly and servicing of the valve 310. That is, housing 320 comprises an upper housing sub 323, an upper intermediate housing sub 324*a*, a lower intermediate housing sub 324*b*, and a lower housing sub 325. Lower intermediate housing sub 324*b* is provided with a plurality of flow ports 322 and both upper and lower intermediate housing subs 324*a* and 324*b* have enlarged internal diameters relative to upper housing sub 323 and lower housing sub 325. Otherwise, the principle differences between housing 320 and housings 20, 120, and 220 relate to various details by which the other components are mounted therein.

Actuation ball seat 331 is mounted on the upper end of reciprocating shifter sleeve 330. Shifter sleeve 330 is substantially similar to shifter sleeves 30, 130, and 230 in, respectively, valves 10, 110, and 210 except that it is assembled from an upper shifter sub 330*a* and a lower shifter sub 330*b*, again to improve assembly and servicing of valve 310. It is mounted for reciprocating movement within housing 320 and is biased upwards by a resilient member, such as compression spring 333. Actuation ball seat 331 is substantially identical to actuation ball seat 31, 131, and 231 in valves 10, 110, and 210. It is a split ring mounted under compression and can selectively capture and release balls pumped into valve 310 to actuate shifter sleeve 330.

As in the other exemplified valves, shifter sleeve 330 is adapted to engage and drive indexed drive sleeve 340 through various index positions. It uses similar ratcheting mechanisms including an inner pawl ring 335 disposed between shifter sleeve 330 and drive sleeve 340 and an outer pawl ring 326 disposed between drive sleeve 340 and lower intermediate housing sub 324*b*. In valve 310, however, outer pawl ring 326 is mounted in lower intermediate housing sub 324*b* and rides in and out of annular detent grooves 346 in the outer surface of drive sleeve 340, and inner pawl ring 345 is mounted in drive sleeve 340 and rides in and out of annular detent grooves 335 in the inner surface of shifter sleeve 330 as shifter sleeve 330 reciprocates. Drive sleeve 340, therefore, will travel down valve 310 one index position at a time.

As in valve 10, valve 310 is provided with a sight hole 329 in lower intermediate housing sub 324*b* by which the index position of the tool may be viewed. The numbers corresponding to the index positions, however, have been etched in the lower portion of drive sleeve 340, instead of the upper portion as in drive sleeve 40 of valve 10. The overall length of valve 310 may thereby be reduced as compared to valve 10.

Figure 12C:
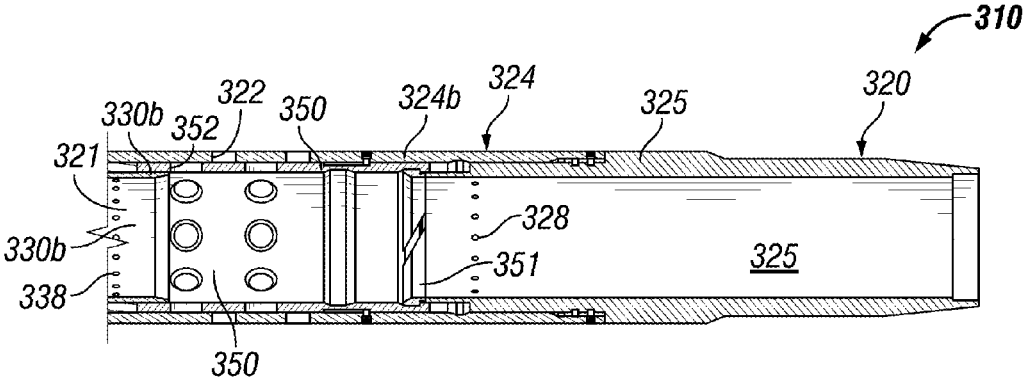
FIG. 12C is an enlarged axial cross-sectional view of the lower portion (corresponding generally to lower portion C of frac valve 10 shown in FIG. 3) of frac valve 310.

Valve sleeve 350 is substantially identical to valve sleeve 50 in valve 10. It is adapted to shut off or to allow fluid flow through flow ports 322 in lower intermediate housing sub 324*b*. It has a number of valve ports 352. When valve sleeve 350 is in its initial, run-in position as shown in FIG. 12C, ports 352 are offset from flow ports 322 in lower intermediate housing sub 324*b* and flow from central conduit 321 to the exterior of housing 320 is shut off. Valve sleeve 350 remains in its initial shut position as balls are pumped through valve 310 to index drive sleeve 340. When drive sleeve 340 is fully indexed, it will actuate valve sleeve 350 and move it from its shut position to its open position, in which open position valve ports 352 are aligned with flow ports 322 in lower intermediate housing sub 324*b*.

Isolation ball seat 351 is substantially identical to isolation ball seat 51 in valve 10. It is a split ring which is adapted to allow balls to pass as valve 310 is indexed, but to capture a ball once flow ports 322 have been opened. Like isolation ball seat 51 of valve 10, isolation ball seat 351 is mounted in valve sleeve 350. As valve sleeve 350 is driven downward to open flow ports 322, it will ride under isolation ball seat 351. A reduced diameter portion of valve sleeve 350 will ramp under isolation ball seat 351, compressing it and allowing it to capture a ball.

Once production begins, balls are able to pass upwards through valve 310 in a manner similar to what occurs in valve 10. The first ball passing up through valve 310 will impact isolation seat 351 and displace it upwards into an area of enlarged diameter in valve sleeve 350. Isolation ball seat 351 then is able to expand and allow balls to flow up through valve 310.

It will be appreciated that valves 10, 110, 210, and 310 and other embodiments of the novel valves typically will incorporate various shear screws and the like to immobilize components during assembly, shipping, or run-in of the valve. Shear screws, for example, typically will be employed to immobilize reciprocating shifter sleeve and indexed drive sleeve of valves 10, 110, 210, and 310. O-rings, for example, may be provided between housing subs and above and below flow ports to provide pressure tight connections. Such features are shown to a certain degree in the figures, but their design and use in tools such as the novel valves is well known and well within the skill of workers in the art. In large part, therefore, discussion of such features is omitted from this description of preferred embodiments.

The various valves 10, 110, 210, and 310 have been described as being incorporated into a liner and, more specifically, a production liner used to fracture a well in various zones along the well bore. A "liner," however, can have a fairly specific meaning within the industry, as do "casing" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. It is, in essence, a "casing" that does not extend from the surface. "Tubing" refers to a smaller tubular conduit, usually less than 4.5" in diameter. The novel valves, however, are not limited in their application to liners as that term may be understood in its narrow sense. They may be used to advantage in liners, casings, tubing, and other tubular conduits or "tubulars" as are commonly employed in oil and gas wells.

Likewise, while the exemplified valves are particularly useful in fracturing a formation and have been exemplified in that context, they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled in the vicinity of a "production" well. Water or other fluids then would be injected into the formation through the stimulation wells to drive hydrocarbons toward the production well. The novel valves may be used in all such stimulation processes where it may be desirable to create and control fluid flow in defined zones through a well bore. Though fracturing a well bore is a common and important stimulation process, the novel valves are not limited thereto.

Exemplified valves 10, 110, 210, and 310 have been disclosed and described as being assembled from a number of separate components. Workers in the art will appreciate that various of those components and other tool components may be separated into multiple components, or may be combined and fabricated as a single component if desired. For example, housings 20, 120, and 220 are assembled from three major components, but in valve 310 the intermediate housing sub 324 is assembled from separate components 324*a* and 324*b*. Likewise, shifter sleeve 330 in valve 310 is assembled from separate components. On the other hand, indexed driver 140 in valve 110 also serves as a valve body. Other modifications of this type are within the skill of workers in the art and may be made to facilitate fabrication, assembly, or servicing of the valves or to enhance its adaptability in the field.

Otherwise, the valves of the subject invention may be made of materials and by methods commonly employed in the manufacture of oil well tools in general and valves in particular. Typically, the various major components will be machined from relatively hard, high yield steel and other ferrous alloys by techniques commonly employed for tools of this type.

While this invention has been disclosed and discussed primarily in terms of specific embodiments thereof, it is not intended to be limited thereto. Other modifications and embodiments will be apparent to the worker in the art.

What is claimed is:

1. A stimulation valve for a well tubular, said stimulation valve comprising:

(a) a cylindrical housing adapted for assembly into a tubular for a well and defining a conduit for passage of fluids through said housing and a port allowing fluid communication between said conduit and the exterior of said housing;

(b) a valve sleeve adapted for movement from a closed position restricting fluid communication through said port to an open position allowing fluid communication through said port;

(c) a driver adapted for linear indexing relative to said housing from an initial position through one or more intermediate positions to a terminal position, said indexed driver being operatively connected to said valve sleeve such that said valve sleeve moves from said closed position to said open position as said indexed driver moves to said terminal position;

(d) a shifter adapted for linear reciprocation relative to said housing, said shifter adapted to index said indexed driver from said initial position through said intermediate positions to said terminal position;

(e) said shifter comprising an actuation seat adapted to receive a ball for actuation of said shifter and to release said ball after actuation of said shifter;

(f) an isolation seat adapted to allow passage of said ball when said indexed driver is in said initial and intermediate positions and to receive said ball when said indexed driver is in said terminal position, said ball restricting fluid flow through said conduit when received by said isolation seat.

2. The stimulation valve of claim 1, wherein said valve body is joined to said indexed driver such that said valve body is indexed from an initial position through intermediate positions to a terminal position, said valve body moving to said open position as said valve body is indexed to said terminal position.

3. The stimulation valve of claim 1, wherein said actuation seat is a split ring carried on said shifter under compression and sized to receive said ball, said split ring being adapted to expand and release said ball after said shifter has indexed said indexed driver.

4. The stimulation valve of claim 3, wherein said valve comprises first and second ratchet mechanisms, said first ratchet mechanism allowing said indexed driver to index relative to said housing and said second ratchet mechanism allowing said indexed driver to index relative to said shifter.

5. A tubular adapted for installation in a well comprising the stimulation valve of claim 4.

6. A method of lining a well, the method comprising installing a tubular comprising the stimulation valve of claim 4.

7. A method of stimulating a formation in a well, said method comprising:

(a) installing a tubular in said well, said tubular comprising an uphole stimulation valve and a downhole stimulation valve, said stimulation valves comprising the stimulation valves of claim 4;

(b) pumping a first ball through said tubular to index said uphole stimulation valve and to open said downhole stimulation valve;

(c) pumping fluid through said tubular and out said opened downhole stimulation valve to stimulate said formation adjacent said downhole stimulation valve;

(d) pumping a second ball through said tubular to open said uphole stimulation valve; wherein said first and second balls are substantially identical; and (e) pumping fluid through said tubular and out said opened uphole stimulation valve to stimulate said formation adjacent said uphole stimulation valve.

8. A tubular adapted for installation in a well comprising the stimulation valve of claim 3.

9. A method of lining a well, the method comprising installing a tubular comprising the stimulation valve of claim 3.

10. A method of stimulating a formation in a well, said method comprising:

(a) installing a tubular in said well, said tubular comprising an uphole stimulation valve and a downhole stimulation valve, said stimulation valves comprising the stimulation valves of claim 3;

(b) pumping a first ball through said tubular to index said uphole stimulation valve and to open said downhole stimulation valve;

(c) pumping fluid through said tubular and out said opened downhole stimulation valve to stimulate said formation adjacent said downhole stimulation valve;

(d) pumping a second ball through said tubular to open said uphole stimulation valve; wherein said first and second balls are substantially identical; and (e) pumping fluid through said tubular and out said opened uphole stimulation valve to stimulate said formation adjacent said uphole stimulation valve.

11. The stimulation valve of claim 1, wherein said shifter is a spring-loaded sleeve.

12. The stimulation valve of claim 1, wherein said valve comprises first and second ratchet mechanisms, said first ratchet mechanism allowing said indexed driver to index relative to said housing and said second ratchet mechanism allowing said indexed driver to index relative to said shifter.

13. The stimulation valve of claim 12, wherein said first ratchet mechanism comprises a pawl adapted to engage detents provided in said housing or said indexed driver.

14. The stimulation valve of claim 12, wherein said second ratchet mechanism comprises a pawl adapted to engage detents provided in said indexed driver or said shifter.

15. A tubular adapted for installation in a well comprising the stimulation valve of claim 12.

16. A method of lining a well, the method comprising installing a tubular comprising the stimulation valve of claim 12.

17. A method of stimulating a formation in a well, said method comprising:

(a) installing a tubular in said well, said tubular comprising an uphole stimulation valve and a downhole stimulation valve, said stimulation valves comprising the stimulation valves of claim 12;

(b) pumping a first ball through said tubular to index said uphole stimulation valve and to open said downhole stimulation valve;

(c) pumping fluid through said tubular and out said opened downhole stimulation valve to stimulate said formation adjacent said downhole stimulation valve;

(d) pumping a second ball through said tubular to open said uphole stimulation valve; wherein said first and second balls are substantially identical; and (e) pumping fluid through said tubular and out said opened uphole stimulation valve to stimulate said formation adjacent said uphole stimulation valve.

18. The stimulation valve of claim 1, wherein said indexed driver is a drive sleeve having a first split ring and a second split ring mounted therein, said first split ring being adapted to selectively engage a first set of annular detents in said housing so as to allow said drive sleeve to index relative to said housing, and said second split ring being adapted to selectively engage a second set of annular detents in said shifter so as to allow said drive sleeve to index relative to said shifter.

19. The stimulation valve of claim 1, wherein said housing has a first split ring mounted therein and said indexed driver is a drive sleeve having a second split ring mounted therein, said first split ring being adapted to selectively engage a first set of annular detents in said drive sleeve so as to allow said drive sleeve to index relative to said housing, and said second split ring being adapted to selectively engage a second set of annular detents in said shifter so as to allow said drive sleeve to index relative to said shifter.

20. The stimulation valve of claim 1, wherein said isolation seat is a split ring sized to allow passage of said ball when said valve body is in said closed position, wherein said split ring is mounted for compression when said valve body is in said open position and is adapted to receive said ball when said split ring is compressed.

21. The stimulation valve of claim 20, wherein said split ring is mounted for compression in said valve body, said valve body having an area of reduced diameter adapted to compress said split ring as said valve body moves from said closed position to said open position.

22. The stimulation valve of claim 21, wherein said valve body has an area of enlarged diameter above said reduced diameter area and said split ring is adapted for displacement into said enlarged diameter area by a ball passing upwards through said valve, said displacement allowing said split ring to expand and allow passage of said ball.

23. The stimulation valve of claim 20, wherein said valve body engages a compression sleeve as said valve body moves from said closed position to said open position and said split ring is mounted for compression in said compression sleeve, said compression sleeve having an area of reduced diameter adapted to compress said split ring as said compression sleeve seat is engaged by said valve body.

24. The stimulation valve of claim 23, wherein said compression sleeve has an area of enlarged diameter above said reduced diameter area and said split ring is adapted for displacement into said enlarged diameter area by a ball passing upwards through said valve, said displacement allowing said split ring to expand and allow passage of said ball.

25. The stimulation valve of claim 20, wherein said split ring is releasably mounted at the lower end of said valve body, said valve body being adapted to transfer said split ring to a compression sleeve as said valve body moves from said closed position to said open position, said compression sleeve being adapted to receive and compress said split ring.

26. The stimulation valve of claim 25, wherein said split ring is adapted for displacement from said compression sleeve by a ball passing upwards through said valve, said displacement allowing said split ring to expand and allow passage of said ball.

27. The stimulation valve of claim 1, wherein said housing defines an intermediate portion having an enlarged diameter and said reciprocating shifter is a sleeve mounted within said intermediate, enlarged diameter portion of said housing, said shifter sleeve having an inner diameter substantially equal to the inner diameter of said housing above and below said intermediate enlarged diameter portion.

28. The stimulation valve of claim 27, wherein said shifter sleeve extends the substantial distance through said enlarged portion of said housing.

29. A tubular adapted for installation in a well comprising the stimulation valve of claim 1.

30. A method of lining a well, the method comprising installing a tubular comprising the stimulation valve of claim 1.

31. A method of stimulating a formation in a well, said method comprising:

(a) installing a tubular in said well, said tubular comprising an uphole stimulation valve and a downhole stimulation valve, said stimulation valves comprising the stimulation valves of claim 1;

(b) pumping a first ball through said tubular to index said uphole stimulation valve and to open said downhole stimulation valve;

(c) pumping fluid through said tubular and out said opened downhole stimulation valve to stimulate said formation adjacent said downhole stimulation valve;

(d) pumping a second ball through said tubular to open said uphole stimulation valve; wherein said first and second balls are substantially identical; and (e) pumping fluid through said tubular and out said opened uphole stimulation valve to stimulate said formation adjacent said uphole stimulation valve.

32. The method of claim 31, wherein said installation of said tubular comprises cementing said tubular in said well.

33. The method of claim 31, wherein said stimulation comprises fracturing said formation.

34. A stimulation valve for a well tubular, said stimulation valve comprising:

(a) a cylindrical housing adapted for assembly into a tubular for a well and defining a conduit for passage of fluids through said housing and a port allowing fluid communication between said conduit and the exterior of said housing, said housing having a longitudinal axis;

(b) a valve sleeve adapted for movement from a closed position restricting fluid communication through said port to an open position allowing fluid communication through said port;

(c) an indexing mechanism adapted for indexing from an initial position through one or more intermediate positions to a terminal position, said indexing mechanism comprising a driver adapted for indexing along an indexing path that is parallel to the longitudinal axis of said housing, and a shifter operatively connected to said indexed driver and adapted to index said indexed driver sequentially through several positions on said indexing path as said shifter reciprocates along a path that is parallel to the longitudinal axis of said housing; said indexing mechanism being operatively connected to said valve sleeve such that said valve sleeve moves from said closed position to said open position as said indexing mechanism moves to said terminal position; and (d) an isolation seat adapted to allow passage of a ball of a defined size when said driver indexing mechanism is in said initial and intermediate positions and to receive a ball of said defined size when said indexing mechanism is in said terminal position;

(e) wherein said isolation seat is adapted for displacement by upward flow of a ball of said defined size, said displacement allowing passage of said displacing ball through said isolation seat.

35. A method of stimulating a formation in a well, said method comprising:

(a) installing a tubular in said well, said tubular comprising an indexing stimulation valve; said indexing stimulation valve having:

i) a valve sleeve adapted for movement from a closed position restricting fluid communication through a port in said valve to an open position allowing fluid communication through said port;

ii) a driver adapted for linear indexing relative to said valve from an initial position through one or more intermediate positions to a terminal position, said indexed driver being operatively connected to said valve sleeve such that said valve sleeve moves from said closed position to said open position as said indexed driver moves to said terminal position;

iii) a shifter adapted for linear reciprocation relative to said valve, said shifter adapted to index said indexed driver from said initial position through said intermediate positions to said terminal position; and iv) an isolation seat which is displaceable from a closed position to an open position;

(b) pumping a first ball through said tubular, said first ball indexing said valve and passing through said valve and said isolation seat;

(c) pumping a second ball substantially identical to said first ball through said tubular, said second ball actuating said valve to open said port and to close said isolation seat such that said second ball is received on said isolation seat to restrict flow through said valve;

(d) pumping fluid out said port to stimulate said formation adjacent said valve;

(e) flowing said first ball upward through said valve, said first ball displacing said isolation seat from said closed position to said open position, thereby allowing said first ball to pass through said valve.

* * * * *